US006650863B2

(12) United States Patent
Fuma

(10) Patent No.: US 6,650,863 B2
(45) Date of Patent: Nov. 18, 2003

(54) FIXING UNIT AND IMAGE FORMING APPARATUS

(75) Inventor: Hiroshi Fuma, Yamahashi (JP)

(73) Assignee: Konica Corporation, Tokyo (JP)

( * ) Notice: Subject to any disclaimer, the term of this patent is extended or adjusted under 35 U.S.C. 154(b) by 54 days.

(21) Appl. No.: 09/975,488

(22) Filed: Oct. 11, 2001

(65) Prior Publication Data

US 2002/0118982 A1 Aug. 29, 2002

(30) Foreign Application Priority Data

Feb. 26, 2001 (JP) ..... 2001-050104
Mar. 12, 2001 (JP) ..... 2001-068399

(51) Int. Cl.[7] ..... G03G 15/20

(52) U.S. Cl. ..... 399/329; 219/216; 399/328; 399/334

(58) Field of Search ..... 219/216; 399/45, 399/67, 69, 320, 322, 328, 329, 330, 331, 333, 334

(56) References Cited

U.S. PATENT DOCUMENTS 6,047,158 A * 4/2000 Morigami et al. ..... 399/328
6,154,629 A * 11/2000 Kinouchi et al. ..... 399/329

* cited by examiner

*Primary Examiner*—Hoang Ngo
(74) *Attorney, Agent, or Firm*—Frishauf, Holtz, Goodman & Chick, P.C.

(57) ABSTRACT

The invention concerns the image forming apparatus incorporating a fixing unit, which is includes either a fixing belt or a fixing roller, and effectively used in a copier or a printer. The fixing unit includes a fixing belt threaded on a plurality of supporting rollers and a temperature-equalizing member to equalize a temperature distribution of the fixing belt in its width direction. The temperature-equalizing member moves from a separate position to a first pressure-contacting position at which the temperature-equalizing member pressure-contacts the fixing belt, and further moves to a second pressure-contacting position while maintaining a pressure-contacting state with the fixing belt. A contact area of the temperature-equalizing member and the fixing belt is enlarged at the second pressure-contacting position, compared to that at the first pressure-contacting position. The temperature-equalizing member can park at either the first pressure-contacting position or the second pressure-contacting position.

31 Claims, 19 Drawing Sheets

FIG. 19 ( b )
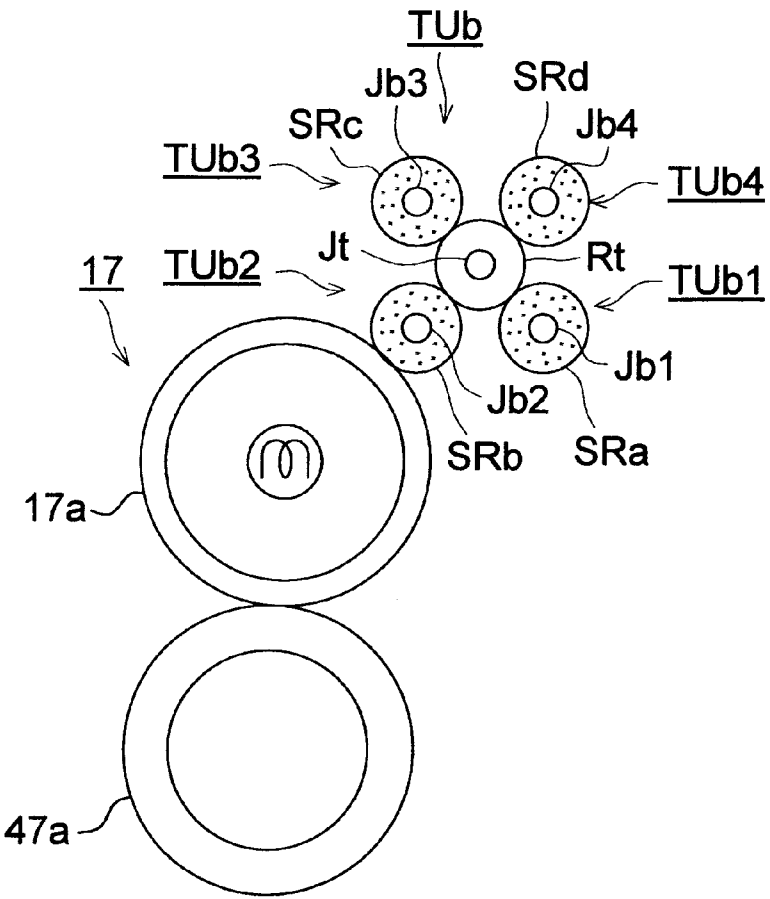
FIG. 19 ( a )
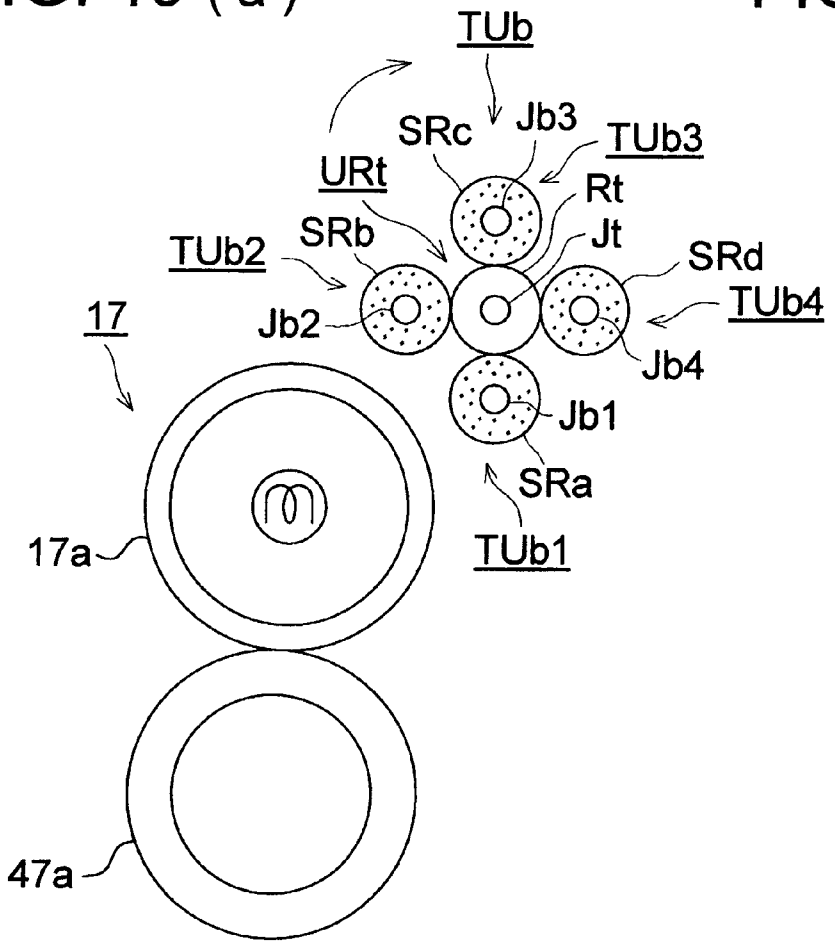

FIG. 24
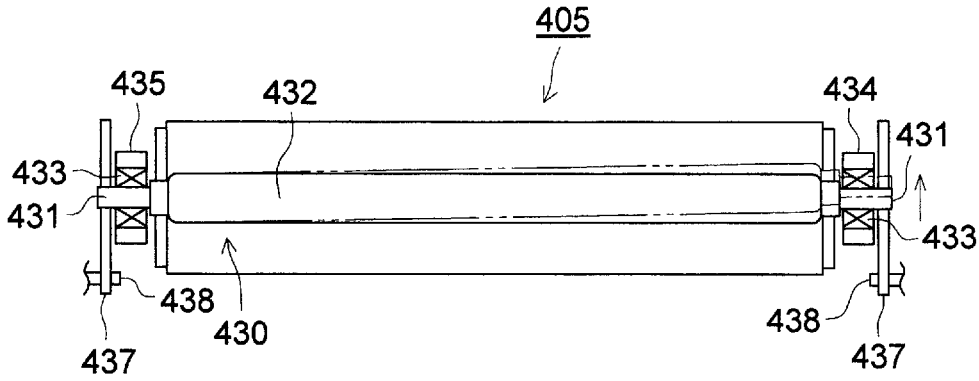
FIG. 25 ( a )
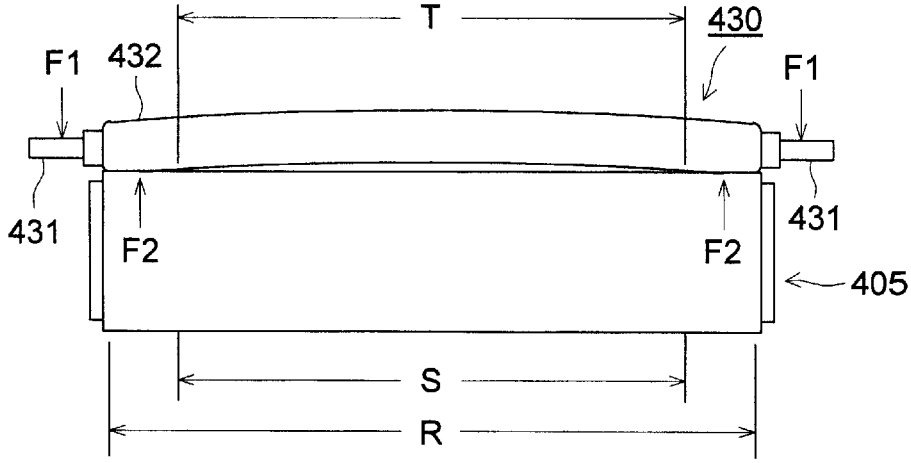
FIG. 25 ( b )
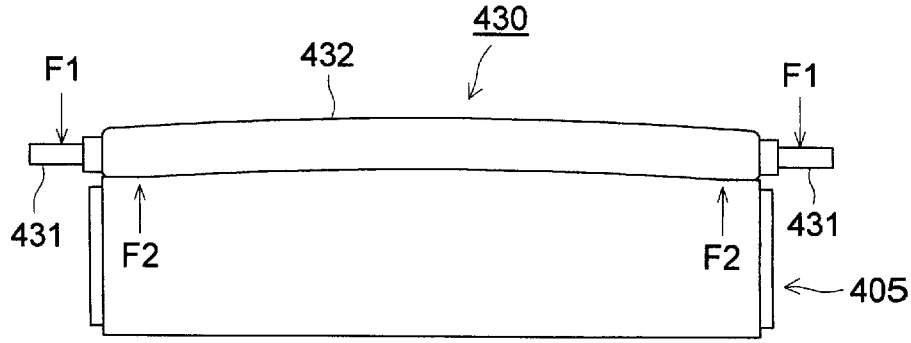

FIXING UNIT AND IMAGE FORMING APPARATUS

BACKGROUND OF THE INVENTION

The present invention relates to the image forming apparatus incorporating a fixing unit, which is includes either a fixing belt or a fixing roller, and effectively used in the image forming apparatus of an electrophotographic copier and printer, and particularly to the fixing unit and image forming apparatus improved to ensure a uniform distribution of the temperature on the surface of the fixing belt or the fixing roller for heating a toner image.

A belt type fixing unit known so far includes the one comprising (1) a backup/heating roller containing a heating means made up of a halogen lamp, (2) a fixing belt applied to two backup rollers consisting of backup/pressure rollers, and (3) a pressure roller which rotates by giving pressure through the aforementioned backup/pressure roller and fixing belt; wherein a toner image is fixed onto the paper with unfixed toner image by the pressure of the pressure roller and heating of the fixing belt.

Such a fixing unit is arranged in such a way that; a temperature sensor as a means of detecting temperature is provided close to or in contact with the external surface of the backup/heating roller on the center in the longitudinal direction, for example, and the output information of the temperature sensor is used to control the power supply to the heating means by a control means, thereby allowing the temperature on the fixing belt surface to be maintained within the range of temperature suited to fixing of toner image.

The above fixing unit is mounted on a wide range of image forming apparatuss for ease of handling. One of the problems with the aforementioned fixing unit, however, is how to reduce the warming up time. Many proposals have been made during the course of a long period of time. One of such proposals is to decrease heat capacity by reducing the thickness of an endless fixing belt.

This is to reduce the thickness of the metallic substrate at the center constituting the fixing belt and the rubber on the outside layer, thereby ensuring the temperature on the fixing belt surface to reach the toner fixing temperature earlier.

It has been found out, however, that another issue occurs even if the thickness of the fixing belt can be reduced to ensure a specified mechanical strength to be maintained, and even if it is possible to reduce the time until stable fixing of the fixing belt surface is ensured after electric power is supplied to the heating means.

For example, when continuous fixing is performing using a small-sized paper with a toner image formed which is fed at the center with reference to the fixing belt, heat on the surface of the fixing belt corresponding to the aforementioned small-sized paper feed area is consumed to heat the paper. However, heat on the surface of the aforementioned fixing belt corresponding to the non-paper feed area on the right and left sides is not consumed. Moreover, heat is stored in the non-paper feed area due to a small shift of heat along the direction of the width of the fixing belt.

Further, electric power is supplied to the heating means to ensure that the temperature on the fixing belt surface in the paper feed area deprived of heat can be kept at a specified fusible temperature. This will increase the amount of heat stored in the portion of the fixing belt corresponding to the aforementioned non-paper feed area, with the result that the temperature range suited for fixing is much exceeded.

When large-sized paper utilizing the non-paper feed area on the right and left sides of the fixing belt is used at the time of the excessive temperature rise mentioned above, and the toner image formed on this paper must be fixed, then irregularity of gloss or high temperature offset occurs to the surface of the paper in conformity to irregular forms of the paper and toner layer caused by the difference of the temperatures heretofore between paper feed area and non-paper feed area. This will reduce the service life of the rubber layer of the fixing belt.

Suck a problem is caused by the aforementioned fixing belt which is made into a substance of low heat capacity through the reduction of the thickness of the fixing belt, with the result that there is a reduction in the function of shifting the heat stored in the non-paper feed area to a place of lower temperature.

Another example of the known image forming apparatus is the one provided with a fixing unit arranged in such a way that paper carrying a toner image is fed between the fixing belt rotatably supported by the backup roller and heated by a proper heating source, and a roller which rotates in contact with this fixing belt, and the aforementioned toner image is fixed to this paper by the pressure and heat produced between the two.

One form of the aforementioned fixing unit conceivable is the one where a heating source consisting of a halogen lamp is installed inside the loop formed by a fixing belt to heat the fixing belt directly, thereby reducing the warming up time.

Such a system, however, is accompanied by the following problem: During the standby period subsequent to the temperature of the fixing belt having been raised to the value which permits fixing, the temperature of the aforementioned fixing belt must be kept at the value allowing fixing or at a proper value lower than the fusible temperature with consideration given to energy saving. This requires the fixing belt to be rotated in order to maintain the temperature of the entire fixing belt, because the heat source is arranged opposite to part of the fixing belt. Further, a greater amount of heat is discharged due to a greater size of the fixing belt, with the result that energy efficiency is poor in such a conventional system.

Further, when paper of a smaller size with respect to the width for fixing and heating on the fixing belt is subjected to continuous fixing in the fixing process for example, there is an excessive rise of temperature in the non-paper feed area (e.g. the portion formed on the right and left sides of the fixing belt which does not contribute to fixing). If large-sized paper is subjected to fixing under this condition, irregular fixing occurs on paper in such a conventional system.

In other words, when the image forming apparatus is assumed to be arranged with reference to the center in such a way that there is an agreement between the center of the fixing belt along the direction of the width and that of the paper to be fixed, for example, the temperature sensor is installed close to or in contact with the center of the fixing belt along the direction of the width. Power supply to the heat source is controlled based on the information detected by this temperature sensor.

Accordingly, the fixing belt of the paper feed area in contact with the small-sized paper is always maintained at a fusible temperature, but the heat of the non-paper feed area is hardly used. Moreover, excessive amount of heat is stored because the heat is replenished by turning on the heat source for keeping the temperature in the paper feed area. This gives rise to the aforementioned problem.

This problem is caused by poor heat transfer capacity along the direction of the width as a result of reducing the heat capacity of the fixing belt.

In a fixing unit used in an image forming apparatus such as a copier, printer and facsimile machine characterized by a high level of technological perfection and high stability, a heating roller fixing method using a rubber roller as a fixing heating roller is employed over an extensive scope ranging from low speed to high speed machines and from monochrome to full-color machines.

In the fixing unit according to the conventional heating roller fixing method, however, a heating roller for fixing with a high heat capacity must be heated when the transfer material or toner is heated, and this is disadvantageous in energy saving. Moreover, this requires much time in warming the fixing unit at the time of printing (longer warming up time).

To solve this problem, a fixing unit according to film fixing method has been proposed and has come into use in recent years. This fixing unit is characterized by; (1) a substantial improvement in heat conductivity realized by the heat capacity reduced by use of a film (thermal fixing film) which allows the heating roller to be made into a thermal fixing film having the ultimate thickness, and (2) a quick start method which saves energy and which hardly requires warming up time, this quick start method being realized by direct contact of a temperature-controlled heat-generating body (ceramic heater) and inductive heat generating body to the thermal fixing film.

Further, Japanese Patent Laid-Open NO. Sho52-106741, Japanese Patent Laid-Open NO. Sho57-82240, Japanese Patent Laid-Open NO. Sho57-102736 and Japanese Patent Laid-Open NO. Sho57-102741 disclose a fixing method characterized by quick start without requiring warming up time, wherein a substrate (transparent base body) is used as a heat fixing roller (fixing roller member) which is a variation of the heating roller, and the heat from the halogen lamp (heating means) installed inside is irradiated to toner, whereby heating and fixing are performed. Further, Japanese Patent Laid-Open NO. Sho59-65867 discloses a fixing method wherein a fixing roller is configured with a light absorbing layer provided on the outer surface of the substrate (transparent base body), and light from a halogen lamp (heating means) installed inside the cylindrical transparent base body is absorbed by the light absorbing layer provided on the outer surface of the transparent base body, whereby a toner image is fixed by the heat of the light absorbing layer.

Both the fixing units disclosed in the Japanese Patent Laid-Open NO. Sho52-106741 and the Japanese Patent Laid-Open NO. Sho59-65867 are intended to realize energy saving and quick start based on reduced warming up time. In the former fixing unit, the light from the halogen lamp (heating means) is irradiated through the substrate (transparent base body) to heat and fix the toner. In the latter fixing unit, a fixing roller is arranged by providing a light absorbing layer on the outer surface of the substrate (transparent base body) and light from the halogen lamp is applied to the absorbing layer through the transparent base body and the toner is fixed by the heat of this absorbing layer. However, fixing performances are poor. To solve this problem, the present inventors proposed in the Japanese Patent Laid-Open NO. Hei11-327341 a fixing unit and an image forming apparatus using this fixing unit characterized by quick start (high-speed eating) and excellent fixing capability, wherein a halogen lamp (heating means) is used, and elastic layer (translucent elastic layer) consisting of a rubber layer is provided between the transparent base body and light absorbing layer to form a fixing roller made of a soft roller, thus allowing the absorbing layer to be heated by the light from the halogen lamp (heating means).

In the fixing roller member of the fixing unit used in the aforementioned image forming apparatus, a glass member is mainly used as a transparent base body. The fixing roller member using the glass member (glass core) as a transparent base body enables short-time preheating, but it is characterized by lower than the one using the metallic member (metallic core). So when a transfer material (recording paper) with the width smaller than the heating width of the heating means (halogen lamp) is passed, earlier deterioration of the fixing roller member will be caused by an excessive rise of temperature at the end portion. To solve this problem, a temperature-equalizing roller in contact with the fixing roller member is used in order to shift (disperse) the heat on the surface of the fixing roller member. However, this has the problem of prolonged preheating time in the fixing unit. At the time of continuous passing of transfer materials of small width, it is not effective in reducing the temperature rise on the end portion of the fixing roller, due to lack of uniformity in the widths of the nip portions (equalization roller nip portions) between the fixing roller member and temperature-equalizing roller, or due to ineffective heat dispersion of the fixing roller member by the temperature-equalizing roller. This results in earlier deterioration of the fixing roller member. It is also difficult to avoid an increase in the size of the fixing unit of complicated structure used for formation of color image.

Also known is an image fixing unit arranged in such a way that the recording paper (hereinafter referred to as "paper") carrying an toner image is led to the image fixing unit called a heating roller type fixing unit, and is made to pass between a rotable fixing roller with a built-in heat source and a nip roller which rotates pressing against this fixing roller; wherein the aforementioned toner image is fixed on the paper by the pressure and heat provided by these two rollers.

Also known is the art of temperature control, which ensures the temperature on the surface of the fixing roller to be kept within the range of a specified temperature in the aforementioned image fixing unit.

The aforementioned image fixing unit is very useful because of easy handling, compact configuration and excellent safety, and is built in a great variety of image forming apparatus. It is now put into effective use.

However, when the core of the fixing roller is made, for example, of glass, and arrangements are made to enable quick warming up, the following problems occur:

Namely, when the paper having a width smaller than heating width has to be treated on a continuous basis, the roller containing the aforementioned roller core has a lower heat conductivity than the roller with a metallic core. So even if effective fixing of paper is possible, temperature in the area outside the contact area with paper, namely, the temperature on both ends of the heating width on the fixing roller becomes excessive. If wide paper is treated under this condition, irregular gloss will be produced on the paper corresponding to the boundary area of temperature. To prevent temperature rise on the end portion, an art of installing a cooling fan is also proposed, but thermal efficiency is poor.

SUMMARY OF THE INVENTION

To overcome the abovementioned drawbacks in conventional image-forming apparatus and fixing units, objects of the present invention will be described in the following.

The first object of the present invention is to provide a fixing unit characterized by reducing the rise of temperature in the non-paper passing area of the fixing belt whose wall thickness is reduced for decreased heat capacity and by ensuring a uniform temperature distribution on the surface of the fixing belt suited to fixing of toner image on paper, thereby solving the problem of irregular gloss or high temperature offset.

The second object of the present invention is to provide (1) a fixing unit characterized by shorter warming up time without the need of rotating the fixing roller even in the state of waiting for fixing, and (2) an image forming apparatus which enables a quick re-rise of temperature when the waiting mode is switched over to the fixing mode.

The third object of the present invention is to provide an image forming apparatus designed in a simple structure which ensures effective heat transfer in the paper passing area and non-paper passing area on the fixing belt and enables a uniform temperature to be maintained on the surface of the fixing belt.

The fourth object of the present invention is to provide an image forming apparatus designed in a simple structure characterized by (1) reducing the rise of temperature at the end portion of the roller member at the time of continuous passing of the transfer material of small width, without affecting the preheating time of the fixing unit, (2) enabling quick startup, and (3) incorporating a fixing unit the optimum to color image formation.

The fifth object of the present invention is to provide an image forming apparatus designed in a simple structure capable of reducing the excessive rise of temperature on both ends on the fixing roller even in the process of continuous passing of paper having a width smaller than heating width on the fixing roller.

Accordingly, to overcome the cited shortcomings, the abovementioned objects of the present invention can be attained by fixing units and image-forming apparatus described as follow.

(1) A fixing unit, comprising: a fixing belt threaded on a plurality of supporting rollers; and a temperature-equalizing member to equalize a temperature distribution of the fixing belt in its width direction; wherein the temperature-equalizing member moves from a separate position to a first pressure-contacting position at which the temperature-equalizing member pressure-contacts the fixing belt, and further moves to a second pressure-contacting position while maintaining a pressure-contacting state with the fixing belt; and wherein a contact area of the temperature-equalizing member and the fixing belt is enlarged at the second pressure-contacting position, compared to that at the first pressure-contacting position, and the temperature-equalizing member can park at either the first pressure-contacting position or the second pressure-contacting position.

(2) The fixing unit of item 1, wherein the temperature-equalizing member is pressed onto a supporting roller, serving as one of the supporting rollers, with the fixing belt between them, and moves along an outer shape of the supporting roller.

(3) The fixing unit of item 1, wherein the temperature-equalizing member is a metallic roller.

(4) The fixing unit of item 3, wherein the metallic roller comprises: a release layer having a thickness in a range of 10–100 $\mu$m and provided on an outer surface of the metallic roller.

(5) The fixing unit of item 1, wherein the temperature-equalizing member moves from the first pressure-contacting position to the second pressure-contacting position either continuously or step by step.

(6) An image-forming apparatus having a function of fixing a toner image onto a sheet, comprising: a fixing belt threaded on at least two of supporting rollers; and a temperature-equalizing member equipped in a vicinity of a supporting roller, serving as one of the supporting rollers, to equalize a temperature distribution of the fixing belt in its width direction; a sheet-size detecting section to detect a size of the sheet currently selected; a temperature detecting section to detect a temperature of the temperature-equalizing member; and a controlling section to control a moving action of the temperature-equalizing member so that, when the sheet-size detecting section detects that the size of the sheet is small, the temperature-equalizing member pressure-contacts the fixing belt at a first contacting position, and to change a contact angle of the fixing belt, when the temperature detecting section detects that the temperature of the temperature-equalizing member exceeds a reference value.

(7) The image-forming apparatus of item 6, wherein, when the temperature of the temperature-equalizing member, positioned at the first contacting position, exceeds the reference value, the controlling section controls the moving action of the temperature-equalizing member so that the temperature-equalizing member moves along an outer shape of the supporting roller to a second contacting position, while being pressed onto the supporting roller with the fixing belt between them.

(8) An image-forming apparatus having a function of fixing a toner image onto a sheet, comprising: a fixing belt threaded in a shape of a loop; a heat source to heat the fixing belt up to a fixable temperature, which makes a fixing operation possible; and a temperature-equalizing member, disposed in an interior of the loop, to equalize a temperature distribution of the fixing belt in its width direction; wherein the temperature-equalizing member moves between a release position at which the temperature-equalizing member does not contact the fixing belt and a pressure-contacting position at which the temperature-equalizing member pressure-contacts the fixing belt.

(9) The image-forming apparatus of item 8, further comprising: a sheet-size detecting section to detect a size of the sheet currently selected; wherein, when the sheet-size detecting section detects that the size of the sheet is smaller than a fixable width of the fixing belt, the temperature-equalizing member pressure-contacts the fixing belt at the pressure-contacting position.

(10) The image-forming apparatus of item 8, wherein a base of the fixing belt is made of a metallic material.

(11) The image-forming apparatus of item 8, wherein the temperature-equalizing member is made of aluminum.

(12) The image-forming apparatus of item 9, wherein, when the sheet-size detecting section detects that the size of the sheet is a predetermined small size, and detects that a large number of sheets, which exceeds a predetermined number of sheets, are continuously processed in the fixing operation, the temperature-equalizing member pressure-contacts the fixing belt at the pressure-contacting position.

(13) An image-forming apparatus having a function of fixing a toner image onto a sheet, comprising: a fixing roller, including a heater and a base body on which an elastic layer is formed; and a temperature-equalizing roller to equalize a temperature distribution of the fixing roller in its width direction; wherein the temperature-equalizing member can pressure-contact the fixing roller with a pressure-contacting force, and can be released from a pressure-contacting state; and wherein a value of the pressure-contacting force is selectable in a plurality of step values.

(14) An image-forming apparatus having a function of fixing a toner image onto a sheet, comprising: a fixing roller, including a heater and a base body on which an elastic layer is formed; and a temperature-equalizing roller unit to equalize a temperature distribution of the fixing roller in its width direction; wherein the temperature-equalizing roller unit includes a temperature-equalizing roller and a shaft, serving as a rotating axis of the temperature-equalizing roller; and wherein the temperature-equalizing roller is movable in a longitudinal direction of the shaft.

(15) The image-forming apparatus of item 14, wherein the temperature-equalizing roller is movably coupled to the shaft by engaging female and male screws formed on the temperature-equalizing roller and the shaft respectively.

(16) The image-forming apparatus of item 14, wherein a rotating velocity of the shaft is variable.

(17) The image-forming apparatus of item 15, wherein two temperature-equalizing rollers are movably coupled to the shaft, and a winding direction of the female screw formed on one of the two temperature-equalizing rollers is opposite to that formed on the other one.

(18) The image-forming apparatus of item 17, wherein a total length of the two temperature-equalizing rollers is substantially equal to a maximum width of the sheet.

(19) An image-forming apparatus having a function of fixing a toner image onto a sheet, comprising: a fixing roller, including a heater and a base body on which an elastic layer is formed; and a temperature-equalizing roller unit to equalize a temperature distribution of the fixing roller in its width direction; wherein the temperature-equalizing roller unit includes two temperature-equalizing rollers, a shaft serving as a rotating axis of the two temperature-equalizing rollers and a phase deviation preventive member to fix a mutual phase relationship between the two temperature-equalizing rollers in respect to the shaft; and wherein the two temperature-equalizing rollers are movable in a longitudinal direction of the shaft.

(20) The image-forming apparatus of item 19, wherein the phase deviation preventive member is insertably and drawably engaged into the two temperature-equalizing rollers.

(21) The image-forming apparatus of item 19, wherein a total length of the two temperature-equalizing rollers is substantially equal to a maximum width of the sheet.

(22) The image-forming apparatus of item 13, wherein the fixing roller comprises a transparent base body.

(23) The image-forming apparatus of item 13, wherein a diameter of the temperature-equalizing roller gradually decreases according as a position of the diameter approaches an end of the temperature-equalizing roller, so that the temperature-equalizing roller partially contacts the fixing roller.

(24) An image-forming apparatus having a function of fixing a toner image onto a sheet, comprising: a fixing roller, including a heater and a base body on which an elastic layer is formed; and a plurality of temperature-equalizing roller units to equalize a temperature distribution of the fixing roller in its width direction; wherein each of the temperature-equalizing roller units contacts the fixing roller at each of areas being different relative to each other.

(25) The image-forming apparatus of item 24, wherein the temperature-equalizing roller units pressure-contact the fixing roller in a plurality of pressure-contacting modes.

(26) The image-forming apparatus of item 25, wherein one of the pressure-contacting modes is selected corresponding to temperatures of temperature-equalizing rollers mounted on the temperature-equalizing roller units, or a width of the sheet, or combination of the temperatures of the temperature-equalizing rollers and the width of the sheet.

(27) The image-forming apparatus of item 25, wherein the temperature-equalizing roller units contact a non-contacting roller, which is not in contact with the fixing roller.

(28) The image-forming apparatus of item 27, wherein a surface of the non-contacting roller is coated with an elastic material.

(29) The image-forming apparatus of item 24, wherein the temperature-equalizing roller units are disposed at adjacent positions, so that the temperature-equalizing roller units contact each other.

(30) The image-forming apparatus of item 29, wherein a number of the temperature-equalizing roller units is an even number.

(31) The image-forming apparatus of item 30, wherein surfaces of temperature-equalizing rollers, mounted on at least a half number of the temperature-equalizing roller units, are coated with an elastic material.

(32) The image-forming apparatus of item 24, wherein the fixing roller comprises a transparent base body.

(33) The image-forming apparatus of item 24, wherein one of the temperature-equalizing roller units comprises a temperature-equalizing roller, and a diameter of the temperature-equalizing roller gradually decreases according as a position of the diameter approaches an end of the temperature-equalizing roller, so that the temperature-equalizing roller partially contacts the fixing roller.

(34) A fixing unit, comprising: a fixing roller; and a temperature-equalizing roller to equalize a temperature distribution of the fixing roller in its width direction; wherein the temperature-equalizing member can pressure-contact the fixing roller, and can be released from a pressure-contacting state; and wherein an angle, at which a rotating axis of the temperature-equalizing roller is inclined to that of the fixing roller, is changeable.

(35) The fixing unit of item 34, wherein the angle can be controlled in response to a width of a sheet being under a fixing operation.

(36) The fixing unit of item 34, wherein the angle can be controlled in response to a temperature of the temperature-equalizing roller.

(37) The fixing unit of item 34, wherein the fixing roller comprises a transparent base body and a transparent elastic layer.

Further, to overcome the abovementioned problems, other fixing units and image-forming apparatus, embodied in the present invention, will be described as follow:

(38) A fixing unit characterized by comprising a temperature-equalizing member which is fixed and held at the first position in contact with the aforementioned fixing belt by being displaced from a separate position along the direction of the width of the fixing belt applied on multiple backup rollers, serving as supporting rollers, and at the second pressed position where contact area with the aforementioned fixing belt is expanded by being displaced while the pressed position is maintained.

(39) An image forming apparatus characterized by comprising: a fixing belt applied to at least two backup rollers; a temperature-equalizing member installed in the vicinity of one of the aforementioned backup roller; a detecting means for detecting the size of the paper to be used on a selective basis; a control means for ensuring that the temperature-equalizing member is pressed against the first pressed position when the aforementioned detecting means has sensed that the paper is small-sized; a detecting means for detecting the temperature of the aforementioned temperature-equalizing member; and a control means which allows the aforementioned temperature-equalizing member to be moved in such a way that the contact angle with respect to the fixing belt is changed when the temperature of the temperature-equalizing member has exceeded the reference value.

(40) An image forming apparatus characterized in that a heat source is incorporated in at least of the pressing means installed to ensure that the fixing belt and paper can be held in the pressed state, and a heat source is installed for direct heating of the aforementioned belt.

(41) An image forming apparatus characterized in that a heat source is incorporated in at least of the pressing means installed to ensure that the fixing belt and paper can be held in the pressed state, and a heat source is incorporated in at least one of multiple backup rollers for supporting the aforementioned fixing belt.

(42) An image forming apparatus comprising an image forming apparatus described in (40) or (41) wherein control is made to ensure that the temperature of only the pressing means incorporating a heat source is maintained at the specified value by a control means in the standby state subsequent to the arrival of said fixing belt temperature to the fusible temperature.

(43) An image forming apparatus characterized in that a temperature-equalizing roller is provided in the loop of the rotatable fixing belt supported in a loop form where temperature is raised to the fusible temperature by a heat source in such a way that the temperature-equalizing roller can be pressed against the fixing belt and pressing can be released.

(44) An image forming apparatus comprising a fixing unit further comprising a heating means and a fixing roller member having an elastic layer on the substrate, wherein the aforementioned fixing roller member is provided with a temperature-equalizing roller in such a way that the temperature-equalizing roller can be pressed against the fixing belt and that the pressing can be released, and the contact pressure between the temperature-equalizing roller and the fixing roller member can be selected from multiple values.

(45) An image forming apparatus comprising a fixing unit further comprising a heating means and a fixing roller member having an elastic layer on the substrate, wherein the aforementioned fixing roller member is provided with a temperature-equalizing roller for ensuring uniform temperature of the fixing roller member, and the aforementioned temperature-equalizing unit member comprises a temperature-equalizing roller rotary shaft and a temperature-equalizing roller which is movable on the temperature-equalizing roller rotary shaft.

(46) An image forming apparatus comprising a fixing unit further comprising a heating means and a fixing roller member having an elastic layer on the substrate, wherein the aforementioned fixing roller member is provided with a temperature-equalizing roller for ensuring uniform temperature of the fixing roller member, and the aforementioned temperature-equalizing unit member comprises a temperature-equalizing roller rotary shaft and two temperature-equalizing rollers which are movable on the temperature-equalizing roller rotary shaft; the aforementioned image forming apparatus further characterized in that these two temperature-equalizing rollers have a phase deviation preventive member for fixing the mutual phase around the temperature-equalizing roller rotary shaft.

(47) An image forming apparatus comprising a fixing unit further comprising a heating means and a fixing roller member having an elastic layer on the substrate; the aforementioned image forming apparatus further characterized by comprising multiple temperature-equalizing roller units in contact with the aforementioned roller member in different areas.

(48) An image forming apparatus comprising a temperature-equalizing roller arranged in such a way that it can be pressed against a fixing roller and that the pressing can be released, wherein an angle formed between the shaft of the temperature-equalizing roller and that of the fixing roller can be changed.

BRIEF DESCRIPTION OF THE DRAWINGS

Other objects and advantages of the present invention will become apparent upon reading the following detailed description and upon reference to the drawings in which:

FIG. 19(A) and FIG. 19(B) are drawings representing a second example of the configuration of a temperature-equalizing roller;

FIG. 24 is a schematic view representing the case where the shafts of the fixing roller and temperature-equalizing roller agree with each other and are tilted with each other by a certain angle; and FIG. 25(*a*) and FIG. 25(*b*) are schematic views representing the state of clearance when the fixing roller and temperature-equalizing roller are pressed against each other.

DETAILED DESCRIPTION OF THE PREFERRED EMBODIMENT

Figure 1:
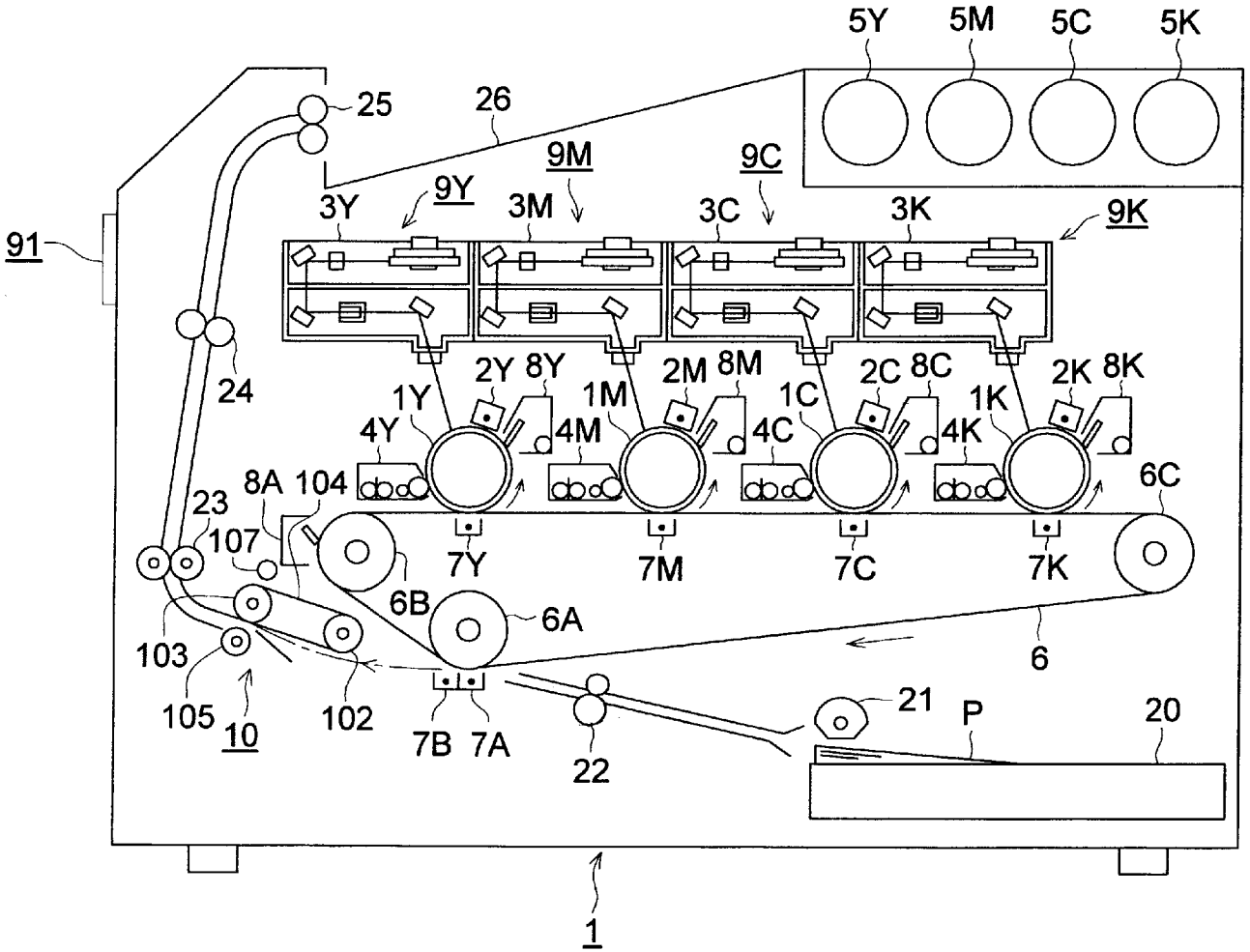
FIG. 1 is a schematic view representing the configuration of a color image forming apparatus.

The following describes the embodiments according to the present invention with reference to drawings:

FIG. 1 is a schematic view representing the configuration of a color image forming apparatus. As illustrated, an image forming apparatus 1 is called a tandem type image forming apparatus, and comprises multiple sets of image forming units 9Y, 9M, 9C and 9K, a belt-shaped intermediate transfer device 6, a paper feed means, a transport means, a toner cartridges 5Y, 5M, 5C and 5K, fixing unit 10 and operation unit 91.

A image forming unit 9Y for forming a yellow image comprises an electric charging means 2Y arranged around the carrier (hereinafter referred to as "photoconductor") 1Y, exposure means 3Y, development unit 4Y, transfer means 7Y and cleaning means 8Y.

The image forming unit 9M forming a magenta image is composed of a photoconductor 1M, electric charging means 2M, exposure means 3M, development unit 4M, transfer means 7M and cleaning means 8M.

The image forming unit 9C forming a cyan image is composed of a photoconductor 1C, electric charging means 2C, exposure means 3C, development unit 4C, transfer means 7C and cleaning means 8C.

The image forming unit 9K forming a back image is composed of a photoconductor 1K, electric charging means 2K, exposure means 3K, development unit 4K, transfer means 7K and cleaning means 8K.

An intermediate transfer device 6 is wound on multiple rollers 6A, 6B and 6C, and is supported rotatably.

Images of various colors composed of image forming units 9Y, 9M, 9C and 9K are sequentially subjected to primary transfer onto the rotating intermediate transfer device 6 by transfer means 7Y, 7M, 7C and 7K, and the synthesized color image is formed.

Paper P stored in the paper feed cassette 20 as a paper feed means is fed by the paper feed roller 21 sheet by sheet, and is transported to the transfer means 7A via a resist roller 22. The aforementioned color image is subjected to the secondary transfer on paper P.

The aforementioned paper P where the color image has been transferred is fixed by the fixing unit 10. Supported by a paper eject roller 25, it is put into a paper eject tray 26 outside the machine via the transport rollers 23 and 24 as transport means.

[First Embodiment]

The fixing unit 10 according to the First Embodiment comprises two backup rollers 102 and 103 (serving as supporting rollers), fixing belt 104, pressure roller 105 pressed against the aforementioned backup roller 103 via the aforementioned fixing belt and temperature-equalizing member 107.

In the meantime, subsequent to secondary transfer of color images on paper P by the transfer means 7A, paper P is separated from the intermediate transfer device 6 by the separation means 7B. Then residual toner is removed from the intermediate transfer device 6 by the cleaning means 8A.

The temperature-equalizing member 107 according to the present invention is installed at a separate position along the direction of the width of the fixing belt 104 applied to the aforementioned backup rollers 102 and 103, as will be described later, and is a metallic roller composed of a member with a high heat conductivity having almost the same length as the of the aforementioned backup roller.

The above has described the color image forming apparatus as an embodiment of the image forming apparatus using the fixing unit containing the aforementioned metallic roller. However, the present invention is not restricted to them. It also applies to the monochrome image forming apparatus.

Figure 2:
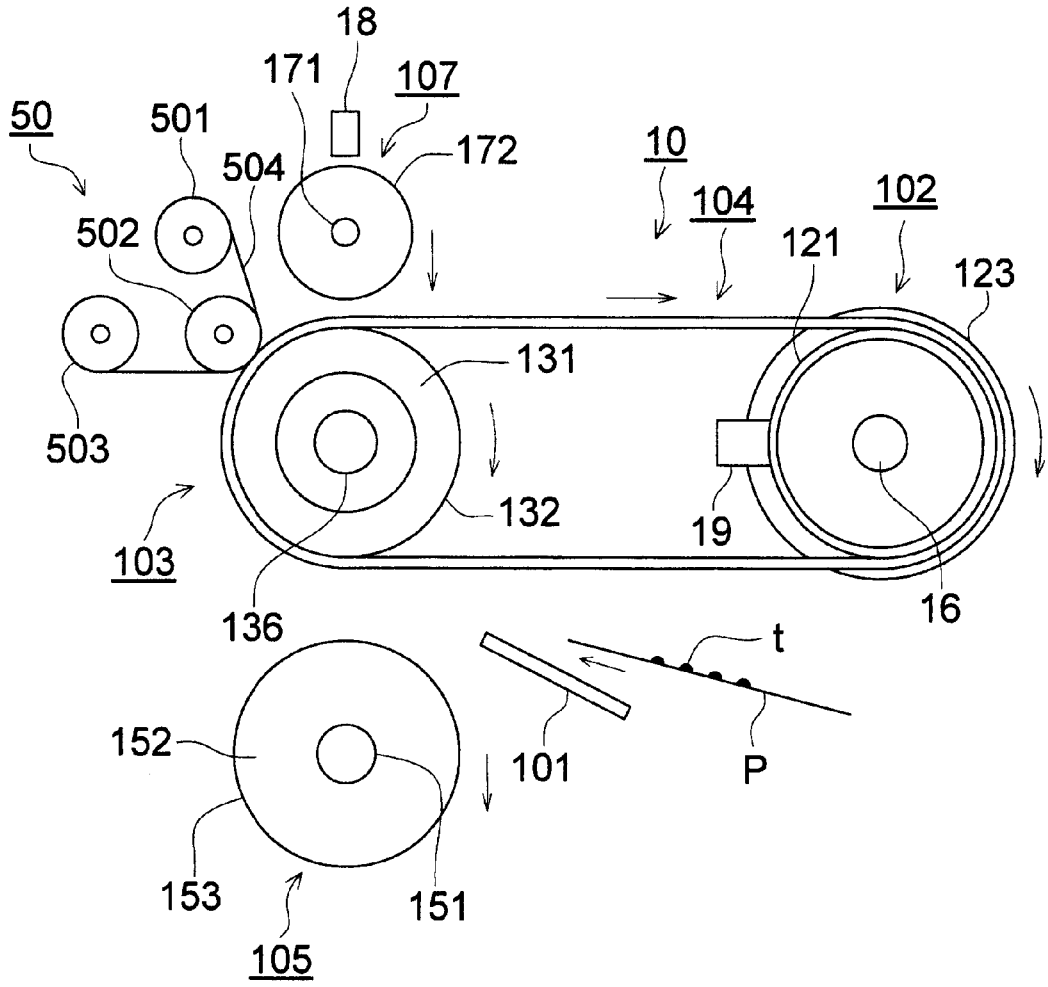
FIG. 2 is a side view giving the schematic representation of a fixing unit.
Figure 3:
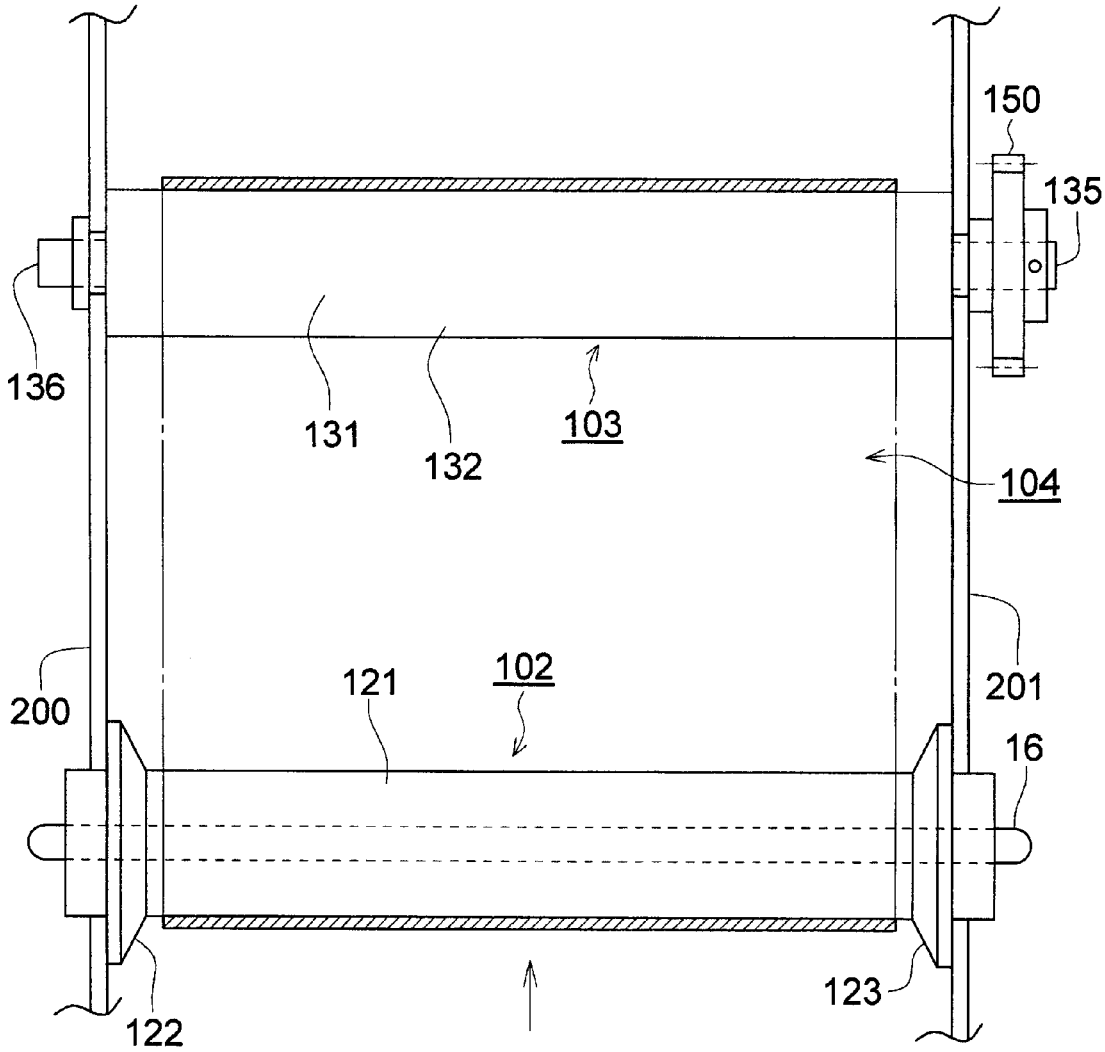
FIG. 3 is a plan view illustrating two back rollers and fixing belt.

FIG. 2 is a side view giving the schematic representation of a fixing unit according to the First Embodiment. FIG. 3 is a plan view illustrating two back rollers and fixing belt.

As shown, the fixing unit 10 comprises a transport guide 101 of paper P with toner image t, a backup roller (hereinafter referred to as "backup/heating roller") 102 including a heating means comprising a halogen lamp 16 in the position fixed state, a backup rollers (hereinafter referred to as "backup/pressure roller)" 103 supporting the fixing belt 104 together with the aforementioned backup/heating roller 102, an endless fixing belt 104 heating the paper P, a pressure roller 105 rotating in contract with the aforementioned backup/pressure roller 103 via the aforementioned fixing belt 104, a temperature-equalizing member (hereinafter referred to as "metallic roller) 107, a cleaning unit 50 for applying oil arranged close to the aforementioned metallic roller 107, a temperature sensor 19 as a means for detecting the temperature of the aforementioned backup/heating roller 102, and a temperature sensor 18 a means for detecting the temperature of the aforementioned metallic roller 107.

The aforementioned backup/heating roller 102 has a mold release layer on the roller substrate 121 and its outside as a surface layer, and the inner diameter surface is coated in black.

The aforementioned roller substrate 121 is made of a thin-walled steel material measuring 40 mm (outer diameter)×38 mm (inner diameter)×approx. 300 mm (roll length) in order to ensure that it has a low heat capacity. A thin-filmed mold release layer comprising the conductive PFA (perfluoro alkoxy vinyl ether polymer, etc.) is provided on its outer surface. The inner diameter surface of the aforementioned roller substrate 121 is provided, for example, with black oxidation treatment for excellent heat absorption. In this way, this roller is arranged as a thin-walled roller which permits quick heating.

Further, ribs 122 and 123 (FIG. 3) are arranged face-to-face with each other on both ends of the aforementioned roller substrate 121. This is intended to prevent the fixing belt 104 from being disengaged from the backup/heating roller 102 and backup/pressure roller 103 when the roller is driven.

Further, the aforementioned backup/heating roller 102 is arranged in such a way that it moves in parallel in the direction of the backup/pressure roller 103 marked with arrow in FIG. 3 when tension is applied by the metallic roller 107 pressed against the fixing belt 104 applied although not illustrated. When not necessary, it is returned to the original position by the action of a spring member.

The aforementioned backup/pressure roller 103 comprises (1) a metallic core 131 made of a steel material measuring 36 mm (outer diameter)×32 mm (inner diameter)×approx. 300 mm (roll length), (2) an elastic layer 132 consisting of heat resistant silicone rubber with an outer diameter of 40 mm provided on the outer surface the aforementioned metallic core 131, (3) a mold release layer having thin PFA film on its outer surface, and (4) bosses 135 and 136 (FIG. 3) provided on both ends.

The aforementioned boss 135 is provided with a gear 150 for transmitting power from the drive source of the image forming apparatus proper.

Two rollers, the aforementioned backup/heating roller 102 and backup/pressure roller 103, are held by bearings mounted on the right and left frames 200 and 201, and can be rotated in the direction of an arrow mark in the drawing. The fixing belt 104 to be described below is also made to turn.

The aforementioned fixing belt 104 is made up of the inner metallic substrate and the outer layer on the outer surface.

The aforementioned metallic substrate comprises an endless belt-shaped nickel layer processed by electroforming and a stainless layer created by welding or rolling, for example.

Furthermore, the outer layer coated with silicone rubber is formed on the outer surface of the metallic substrate, and the aforementioned outer layer has excellent heat resistance and superb toner separability in such a way that paper P with toner image t is pressed and heated at the position where the backup/pressure roller 103 is pressed against the pressure roller 105.

The outer layer comprising the silicone rubber of the fixing belt 104 contacts the toner image t on the aforementioned paper P. In this case, uniform contact is made by following the irregular surfaces of paper P and toner image t due to the elasticity of the silicone rubber, and uniform fixing is ensured through the backup/heating roller 102 by the heat of the fixing belt 104 heated by the halogen heater 16 and pressure applied by the pressure roller 105.

The aforementioned fixing belt 104 comprising two layers is 0.1 mm to 0.2 mm thick, and is stretched between the backup/heating roller 102 and backup/pressure roller 103 at the tension of 1000N/m or less.

The design value of the drive speed of the fixing belt 104 is set at the same as the transport speed of paper P, and the pressure roller 105 and metallic roller 107 to be described later rotate following the fixing belt 104.

The aforementioned pressure roller 105 comprises a metallic core 152 made of a steel material measuring 36 mm (outer diameter)×32 mm (inner diameter)×approx. 300 mm (roll length), an elastic layer 153 consisting of heat resistant silicone rubber with an outer diameter of 40 mm provided on the outer surface the aforementioned metallic core 131, a mold release layer having thin PFA film on its outer surface, and boss 151 (FIG. 3) provided on both ends.

Figure 4:
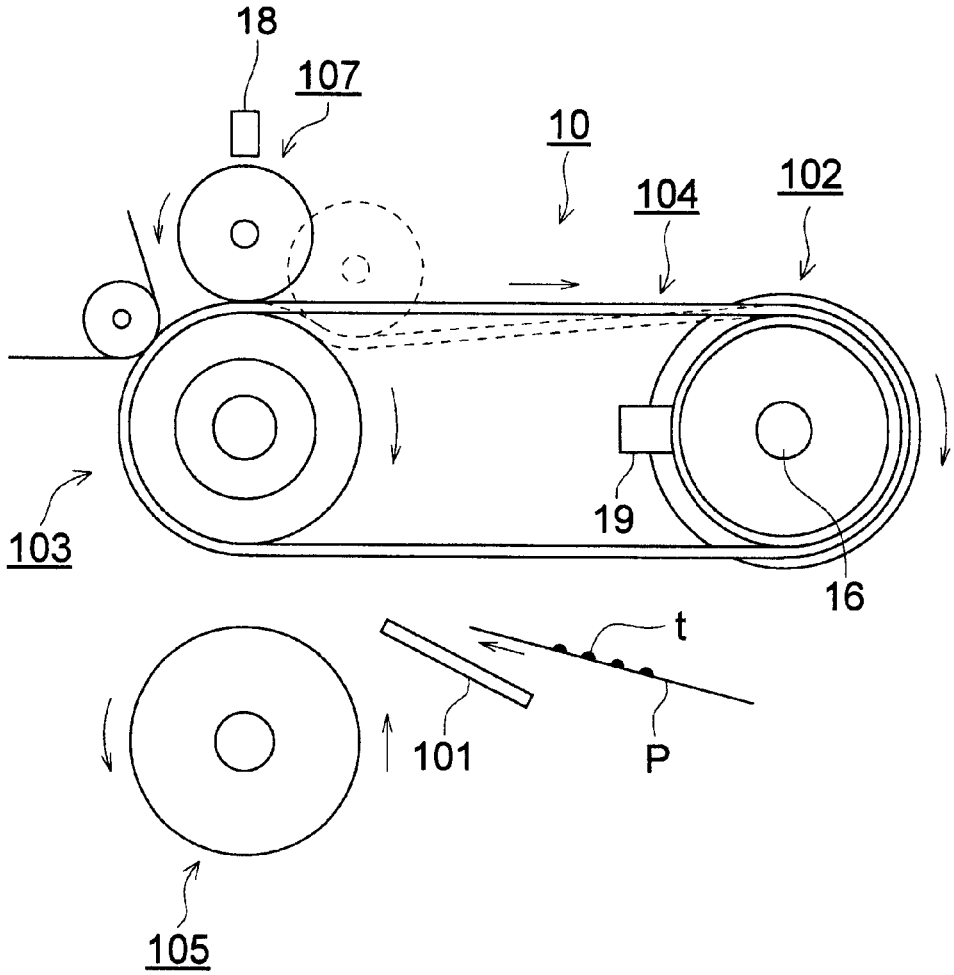
FIG. 4 is a side view representing the fixing unit for illustration of the operation.

The aforementioned pressure roller 105 is arranged in such a way that it rotates in contact with the backup/pressure roller 103 at a fixed position through the aforementioned fixing belt 104 in the direction marked by an arrow (FIG. 4).

When pressing is required, the aforementioned pressure roller 105 as a pressure means is moved toward the backup/pressure roller 103 by the spring member (not illustrated) in the boss 151, and is rotated in contract with pressure applied (FIG. 4). When pressing is not required, contact is released and the roller goes back to the original standby position.

The aforementioned cleaning unit 50 is located outside the closed loop of the fixing belt 104 close to the backup/pressure roller 103, and is composed of a roller 501, pressure roller 502, winding roller 503 and cleaning cloth 504.

The cleaning cloth 504 is paid out from the roller 501 around which the aforementioned cleaning cloth 504 impregnated with silicone oil is wound, and is wound by the winding roller 503 through the pressure roller 502 in contact with the fixing belt 104. Then oil is applied to the fixing belt 104, and, at the same time, the surface of the fixing belt 104 is cleaned.

The aforementioned metallic roller 107 comprises (1) a metallic core 172 made of aluminum material measuring 30 mm (outer diameter)×20 mm (inner diameter)×approx. 300 mm (roll length) and having high heat conductivity, a thin-walled mold release layer formed of 10 to 100 microns as the surface layer of the aforementioned metallic core 172, and (2) a boss 171 provided on both ends of the aforementioned metallic core 172.

The aforementioned metallic roller 107 is arranged so that it is parallel with the backup/pressure roller 103, and can be pressed against it through the fixing belt 104.

When pressing is required, the aforementioned metallic roller 107 as a pressure means is moved toward the aforementioned backup/pressure roller 103 by the spring member (not illustrated) in both of the bosses 171, as shown by the arrow mark, is stopped at the first pressed position equivalent to the tangential line between the fixing belt 104 and backup/pressure roller 103, and is performed to rotate with pressure FIG. 4).

When the surface temperature of metallic roller 107 has exceeded the reference value at the aforementioned the first pressed position, the roller position is shifted with the pressed state maintained, and the roller is fixed and held at the second pressed position where the contract area with the aforementioned fixing belt 104 is expanded.

The pressure of the aforementioned metallic roller 107 against the backup/pressure roller 103 is about 50N.

The following describes the operation of the aforementioned fixing unit 10. According as the paper P having toner image t transported to the fixing area through the transport guide 101, pressure roller 105 arranged in the vicinity outside the fixing belt 104 moves, and paper P is transported as the roller is pressed against the backup/pressure roller 103 through the fixing belt 104.

Toner image t on the aforementioned paper P transported under pressure is molten and fixed by the pressure of the pressure roller 105 and the heat of fixing belt 104.

The aforementioned paper P having been fixed is separated by the curvature of the backup/pressure roller 103 supporting the fixing belt 104. When it comes out of the contact portion between the pressure roller 105 and backup/pressure roller 103, it is cooled by outside air and is placed on the paper eject tray 26 through transport rollers 23 and 24 as a transport means.

Figure 5:
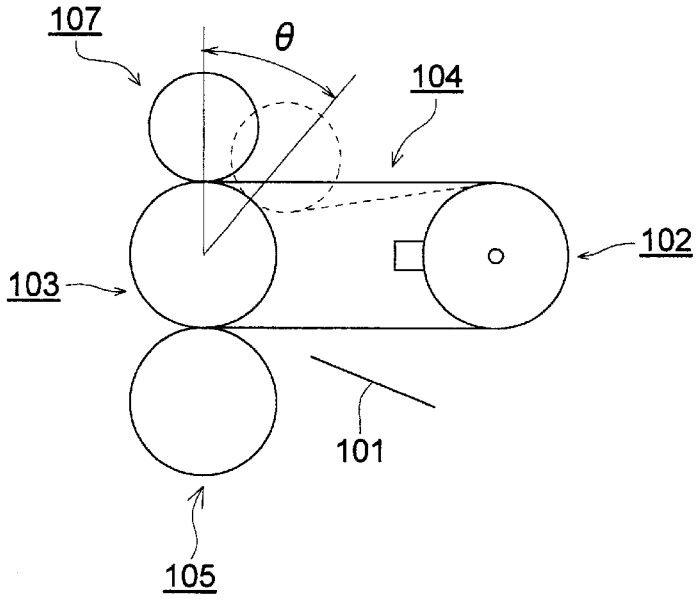
FIG. 5 is a side view of the fixing unit illustrating the contact angle of a metallic roller.

The operation of the following metallic roller 107 is started almost simultaneously with the aforementioned pressure roller 105:

FIG. 4 is a side view representing the fixing unit for illustration of the operation, and FIG. 5 is a side view of the fixing unit illustrating the contact angle of a metallic roller.

Numerals of reference are not explained to avoid overlap with those of FIGS. 1, 2 and 3. The following describes with reference to these drawings: When the system is switched over to the continuous fixing mode for paper whose width is smaller than that of the fixing belt 104, the metallic roller 107 is controlled by the control means (9 to be described later) according to the switching signal from a detecting means (15 to be described later) (not illustrated) for detection of the size of paper P installed in the vicinity of a paper feed cassette 20 as paper feed means.

The aforementioned metallic roller 107 is moved toward the first pressed position shown by a solid line from the separated position along the direction of the width on the backup/pressure roller 103, and is placed in contact through the fixing belt 104.

The aforementioned metallic roller 107 placed in contact absorbs heat on the overheated fixing belt 104 in the non-paper feed area on the right and left sides at the aforementioned the first pressed position, thereby ensuring uniform temperature distribution of the aforementioned fixing belt 104.

When the surface temperature of the aforementioned metallic roller 107 is still low, much heat is removed from the aforementioned fixing belt 104. So contact angle θ of the aforementioned metallic roller 107 on the fixing belt 104 is reduced, namely, the contact area is decreased in such a way that only the adequate amount of heat is absorbed, thereby ensuring uniform temperature distribution on the fixing belt 104.

When a temperature sensor 18 as a detecting means has detected that the surface temperature of the metallic roller 107 at the aforementioned first pressed position has exceeded the reference value, the metallic roller 107 is controlled according to this detection signal, and is moved along the outer shape of the backup/pressure roller 103 with the contact angle changed, while the pressed state with fixing belt 104 is maintained.

As a result of the movement mentioned above, the roller is fixed and held at the next pressed position shown by the dotted line in the drawing, while the contact area (contact angle θ) with the aforementioned fixing belt 104 is expanded.

This is because the contact area must be expanded in order to make up for the heat absorbing capacity of the metallic roller 107 which has been reduced as a result of absorbing heat in an attempt to ensure uniform temperature distribution in the non-paper feed area at the pressed position mentioned above.

When the temperature sensor 18 again detects that the surface temperature of the metallic roller 107 at the position of contact angle (θ) mentioned above has exceeded the reference value, the aforementioned metallic roller 107 is moved to the next pressed position, as in the case of the movement mentioned above.

By repeating these steps, the roller moves to the second pressed position while ensuring a uniform temperature of the overheat fixing belt 104 in the non-paper feed area having occurred in the process of continuous fixing of the small-sized paper P.

Continuous fixing was performed at a transport speed of paper P of 200 mm/sec. in order to by switching the A4 sized 210 mm-wide paper P transported to fixing belt 104 with reference to the center over to the A3 sized 297 mm-wide paper P, by way of an example.

Contact angle θ and temperature (degrees Celsius) of the metallic roller 107 was set in the following give steps ranging from the first pressed position to the last position:

1) 0 deg. below 50° C. (the first pressed position), 2) 5 deg. 50 to 69° C., 3) 10 deg. 70° C. to 89° C., 4) 20 deg. 90° C. to 109° C., 5) 40 deg. 110° C. or higher (equivalent to second fixing position)

Continuous fixing was conducted under the above conditions, with the result that fixing was uniform without uneven gloss.

The best way of determining the aforementioned conditions at present is to consider the differences in the copying speed of the image forming apparatus, paper size and toner melting temperature, as well as conditions of specifications.

Furthermore, the present inventors conducted a stepwise change of the position of the metallic roller 107 from the aforementioned the first pressed position to the second pressed position, and have succeeded in ensuring a uniform temperature distribution of the fixing belt 104 and stable image without reducing the thermal efficiency of the fixing unit 10. This position can be changed continuously.

Furthermore, the reference value of the temperature of the metallic roller 107 can be inferred from the number of prints, and the position of the metallic roller 107 can be changed sequentially.

Upon completion of the aforementioned fixing process, the pressure roller 105 and metallic roller 107 are released, and go back to the original standby position.

Wrinkles or offset of the fixing belt 104 during the contact of the aforementioned two rollers, or shrinkage and elongation resulting from speed differences can be removed by the release the aforementioned two rollers.

If the surface of the aforementioned metallic roller 107 is contaminated with toner or the like, reduced heat shifting capacity or uneven heat shifting will result. To prevent this, it is preferred that the mold release layer made of a very thin film (10 to 100 microns) such as PFA with small thermal resistance be provided as a surface layer of the metallic roller 107.

Figure 6:
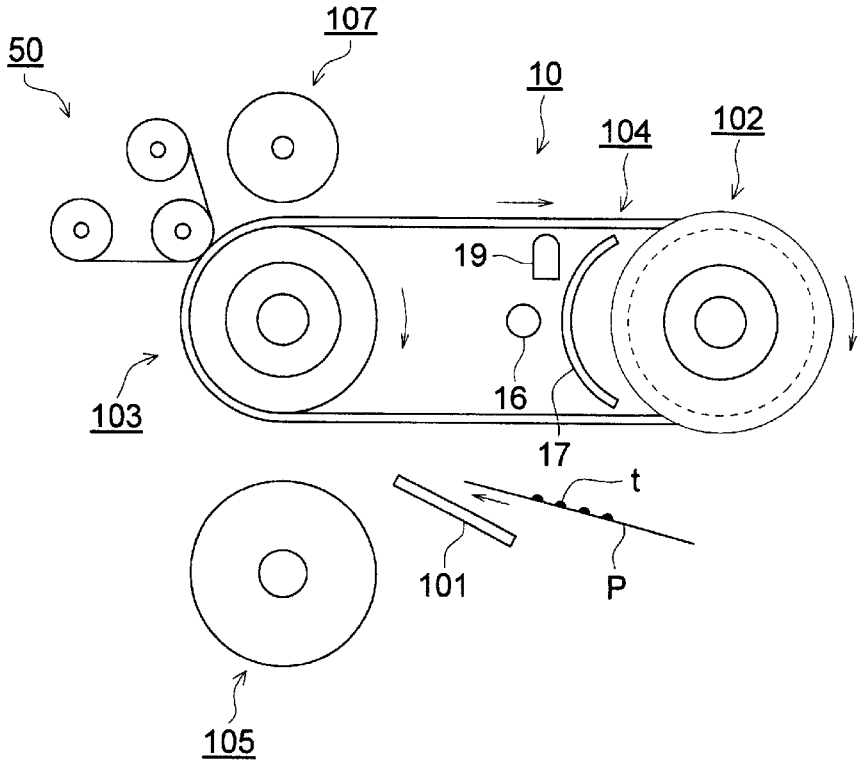
FIG. 6 is a side view representing the fixing unit for illustration of an example where a heating means and others are installed inside the close loop of the fixing belt.

FIG. 6 is a side view representing the fixing unit for illustration of an example where a heating means and others are installed inside the close loop of the fixing belt.

Numerals of reference indicate will be not be described to avoid duplication. As shown in the drawing, the effect of the aforementioned metallic roller 107 is also applicable to the fixing unit 10 provided with a halogen lamp 16 as a heating means a temperature sensor 19 as a means for detecting temperature, and a heat reflector plate 17 inside the closed loop of the fixing belt 104.

Figure 7:
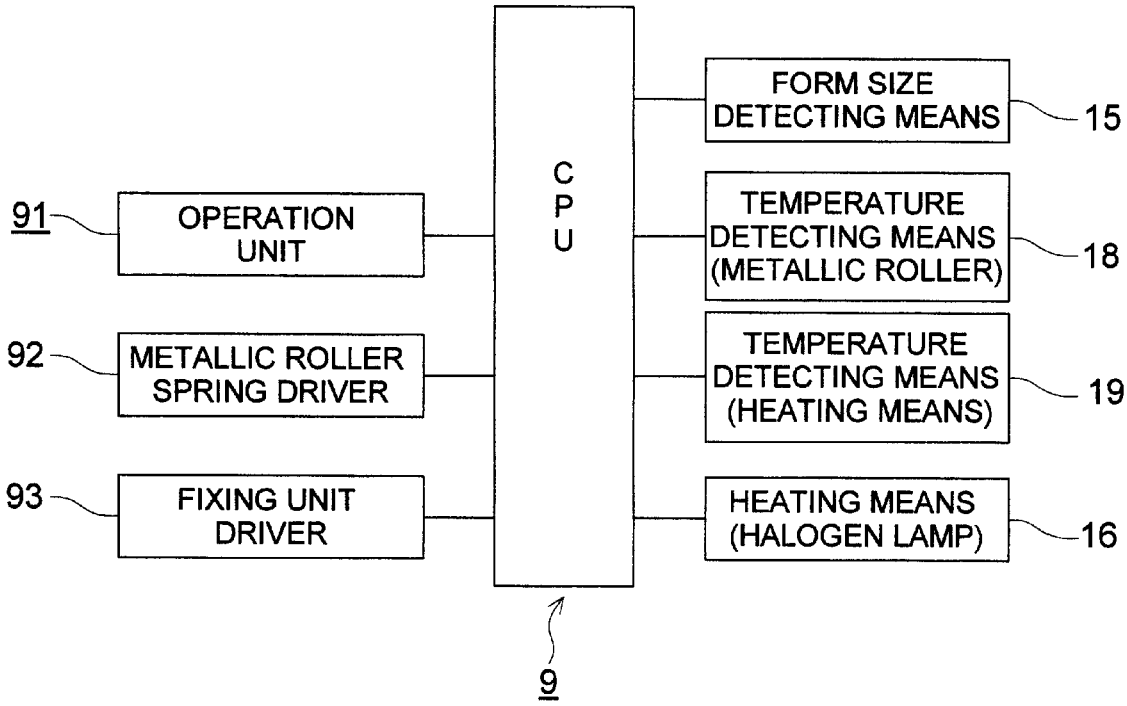
FIG. 7 is a block diagram representing the electric configuration of the image forming apparatus as an embodiment of the present invention.

FIG. 7 is a block diagram representing the electric configuration of the image forming apparatus as an embodiment of the present invention.

As shown in the drawing, the control means 9 comprising the CPU is arranged to operate a heating means 16, metallic roller spring member driver 92 and fixing unit driver 93 according to the inputs from the operation unit 91 of the image forming apparatus, paper size detecting means 15, temperature detecting means 18 of a metallic roller, and temperature detecting means 19 for heating means.

The present invention provides the fixing unit characterized in that a metallic roller is moved along the backup/pressure roller through a fixing belt, and the contact area with the fixing belt is expanded, whereby heat is absorbed from the overheated portion of the non-paper feed area and uniform surface temperature distribution of the fixing belt is ensured, with the result that the temperature suited to fixing of toner image on paper is obtained and problems of uneven gloss or high temperature offset are solved.

[Second Embodiment]

The fixing unit 30 according to the Second Embodiment comprises;

(1) a housing 303 forming an enclosed state except for the entrance/exit of paper P (hereinafter referred to as "outer frame"), (2) a fixing belt 300 designed in an endless form comprising silicone rubber coated on the metallic substrate, (3) a first backup roller 310 and second backup roller 320 rotatably supporting the aforementioned fixing belt, (4) a pressure means (hereinafter referred to as "the first pressure roller" for the sake of expediency) 330 (see FIG. 8) incorporating a heating source (for example, consisting of a halogen lamp) 333 comprising a roller rotatably fixed at a position installed close to the aforementioned first backup roller 310 inside the loop formed by the aforementioned fixing belt 300, (5) a heat source H consisting of a halogen lamp installed between the first pressure roller 330 and second backup roller 320, (6) a reflector plate 350 installed between the aforementioned heat source H and second backup roller 320, and (7) a pressure means (hereinafter referred to as "second pressure roller" for the sake of expediency) 340 comprising a rotatable roller having a silicone rubber layer on the surface and installed face-to-face with the aforementioned first pressure roller 330 outside the aforementioned fixing belt 300.

Control is made in such a way that the aforementioned first pressure roller 330 and second pressure roller 340 are separated from the fixing belt 300 in the non-fixing process, and the aforementioned second pressure roller 340 is located upward in the fixing process. This control allows mechanical contact to be made to ensure that the aforementioned fixing belt 300 is supported (if paper P is present, the aforementioned paper is also supported, as a matter of course).

Two pressure rollers are installed with the center shafts offset to ensure that a curvature of the fixing belt 300 is formed in the fixing process, and promote separation of paper to be fixed at the curvature, in other words, the curvature radius the first pressure roller 330.

Figure 8:
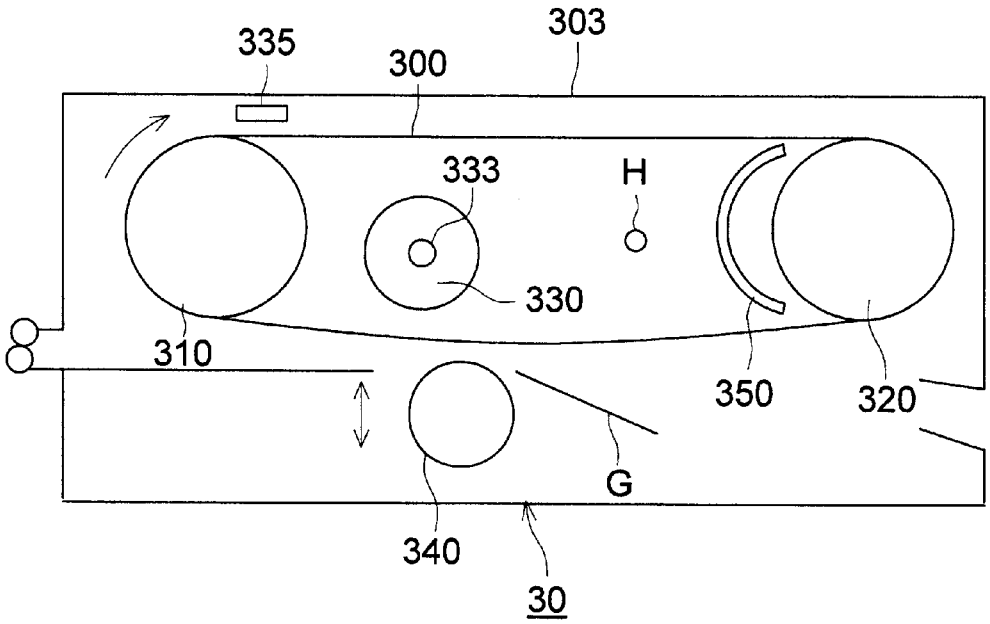
FIG. 8 is a schematic diagram of the fixing unit giving a partially enlarged view of the positional relationship between a fixing belt and a pressure roller in the process of non-fixing treatment.
Figure 9:
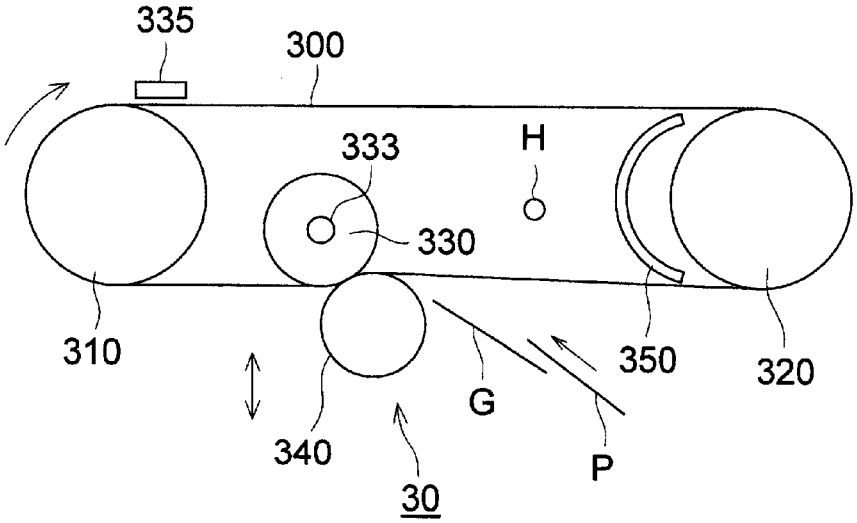
FIG. 9 is a schematic diagram giving a partially enlarged view of the positional relationship between a fixing belt and a pressure roller in the process of non-fixing treatment.

FIG. 8 is a schematic diagram of the fixing unit giving a partially enlarged view of the positional relationship between a fixing belt and a pressure roller in the process of non-fixing treatment. FIG. 9 is a schematic diagram giving a partially enlarged view of the positional relationship between a fixing belt and a pressure roller in the process of non-fixing treatment.

As shown in FIG. 8, the fixing belt according to the present embodiment is applied to the aforementioned first backup roller 310 and second backup roller 320 at a very weak tension or with slack when fixing is not performed.

The aforementioned fixing belt 300 is applied between the first backup roller 310 and second backup roller 320 at a very small tension of 500N/m or less, or more preferably 200N/m or less, for example. However, It can be applied with a slack without tension.

Furthermore, the surface of the aforementioned first pressure roller 330 is covered with a silicone rubber layer or silicone rubber sponge layer. Even if heat escapes through this layer, it is led out into the loop of the aforementioned fixing belt 300. This makes it possible to control the reduction of the fixing belt temperature, thereby ensuring an effective use of heat.

To describe the make arrangements of aforementioned fixing belt 300 more specifically, the fixing belt 300 comprises three layers of a metallic substrate, outer layer and inner layer.

An outer layer formed by coating with silicone rubber characterized by heat resistance and mold release property with respect to toner is provided on the outer surface of the aforementioned metallic substrate. An inner layer formed by coating silicone resin with carbon dispersed therein is provided on the inner layer of the metallic substrate.

In other words, the layer inside the fixing belt 300 is coated with the silicone resin containing dispersed carbon as an infrared ray absorbing material, and is characterized by a high absorbency index of irradiated ray. The temperature can be raised to a specified level (e.g. 190°C.) in a short time by heating from a heat source such as a halogen lamp.

The silicone resin forming the aforementioned inner layer is sufficiently thin (10 to 100 microns), and cannot be removed by flexure during the operation of the fixing belt 300.

Further, the second backup roller 320 in the configuration mentioned above serves as a driving roller of the aforementioned fixing belt 300 through connection with the drive system provided on the side of the image forming apparatus proper.

The first pressure roller 330 mentioned above is also designed to receive power by connection with the drive system on the side of the image forming apparatus proper.

The aforementioned first backup roller 310 is formed by stretching a wire between the backup members (hereinafter referred to as "flanges") on the right and left sides. This will be described later.

In the aforementioned configuration, the shafts J1 and J2 of the aforementioned first backup rollers 310 can be replaced by one shaft. The aforementioned second backup roller 320 may be designed in the same arrangement as that of the first backup roller formed by stretching a wire, as described above.

Further, driving force can be provided from the system side to the aforementioned first backup roller 310 and the aforementioned second backup roller 320, or one of the same sides or both sides of the first backup roller and second backup roller can be connected with a timing belt.

Control according to the present embodiment is provided by a control means S comprising a computer. The aforementioned fixing belt 300 and first pressure roller 330 is driven, for example, by turning on the main switch installed on the image forming, and, at the same time, electric power is supplied to the aforementioned heat source H and 333.

The aforementioned heat source H and 333 are subjected to current application control (power feed control) through the aforementioned control means S, based on the output information from the temperature detecting sensor 335 (FIG. 8) installed almost at the center along the direction of the width of the aforementioned fixing belt 300 (the direction intersecting at right angles to the direction of rotary movement). A specified time after the aforementioned fixing belt 300 has reached the fusible temperature, power supplied to the aforementioned heat source H and 333 is turned off to stop the drive of the aforementioned fixing belt 300 and first pressure roller 330. Then the system gets into the sleep mode.

In the subsequent standby mode (idling time, sleep mode), only the aforementioned heat source 333 is subjected to power supply control.

The outer surface of the aforementioned first pressure roller 330 or its shaft is subjected to power supply control according to the output information of the second temperature detecting sensor (not illustrated).

This control keeps the surface temperature of the aforementioned first pressure roller 330 almost the same as that of the aforementioned fixing belt 300 in the shift from the standby mode to the fusible mode. So heat is not removed from the aforementioned fixing belt or very little heat is removed, even when the aforementioned first pressure roller 330 is brought in contact with the aforementioned fixing belt 300. This has the effect of ensuring stable continuous fixing immediately after warming up in a short time.

When the image forming command is given to the image forming apparatus in the standby mode, power supply control the aforementioned heat source H is restarted.

In this case, the shaft of the aforementioned first pressure roller 330 (the metallic core of the roller actually) is maintained at a specified temperature, so there is almost no need for heating.

Further, the temperature of the aforementioned fixing belt 300 can reach the fusible temperature by heating for a very short time, for example, 15 seconds. This means that there is almost no standby time by reheating. Standby time can be minimized even when the maintained temperature of the aforementioned first pressure roller 330 is low with priority placed on energy conservation.

Immediately before image forming is started and paper P carrying the toner image enters the fixing unit, the aforementioned second pressure roller 340 is fed upward from the position away from the fixing belt. Through the aforementioned fixing belt 300, it is brought to the position of pressing against the aforementioned first pressure roller 330, whereby the system enters the fixing mode.

To minimize the standby time until the actual image forming process is executed after the image forming command (has been input), the maintained temperature of the fixing belt in the standby mode is preferred to be higher (close to the fusible temperature). It is preferred to be lower in order to minimize the energy consumption during the standby time. From the view point of keeping balance between the two, for example, it is preferred that the time elapsed after completion of temperature rise (arrival to the fusible temperature) be monitored by the aforementioned control means S, and the setting temperature be reduced as the time passes.

Prior to fixing, the temperature on the surface of the aforementioned fixing belt 300 is maintained at a specified level to fix the aforementioned toner image. As shown in FIG. 3, the aforementioned second pressure roller 340 is placed in the mode of contact with the aforementioned first pressure roller 330 through the fixing belt 300. As described above, the surface of the aforementioned fixing belt 300 is brought in contact with the toner image side of paper P, and the aforementioned toner images are heated and is fixed on paper P one after another. Paper is separated by the curvature radius of the aforementioned first pressure roller 330 and is transported by pairs of transport rollers R3 to R6 to be ejected out of the machine.

Upon completion of fixing on paper P, the pressure of the aforementioned first pressure roller 330 and second pressure roller 340 is released, and resultant wrinkles and offset of the fixing belt 300 caused at the time of contact under pressure, or elongation and contraction due to difference in speeds are removed.

The aforementioned configuration makes it possible to realize shorter warming up time, higher energy efficiency and greater durability of the fixing belt.

According to the present embodiment, two other backup rollers of the fixing belt and two pressure rollers are used as major component. It is also possible to make arrangements in such a way that the first pressure roller 330 of the configuration incorporating a heat source can serve as the aforementioned first backup roller 310.

Further, the heat source 333 designed in the configuration shown in FIG. 2 or the heat source H designed to heat the fixing belt directly can be built in the aforementioned second backup roller 320.

In this case, the aforementioned second backup roller is preferred to be a thin-walled metallic roller of lower heat capacity.

Further, it is possible to make arrangements in such a way that the pressure roller to be placed normally under pressure in contact with the fixing belt, as shown in FIG. 3. The configuration of causing separation is preferred because heat capacity requiring rise of temperature again from the standby mode is smaller by the amount equivalent to the second pressure roller.

When continuous fixing accompanying the continuous image forming is required, it is possible to make arrangements in such a way that the state of contact under pressure is maintained until the end of treatment of the final paper, in other words, the completion of one batch.

Figure 10:
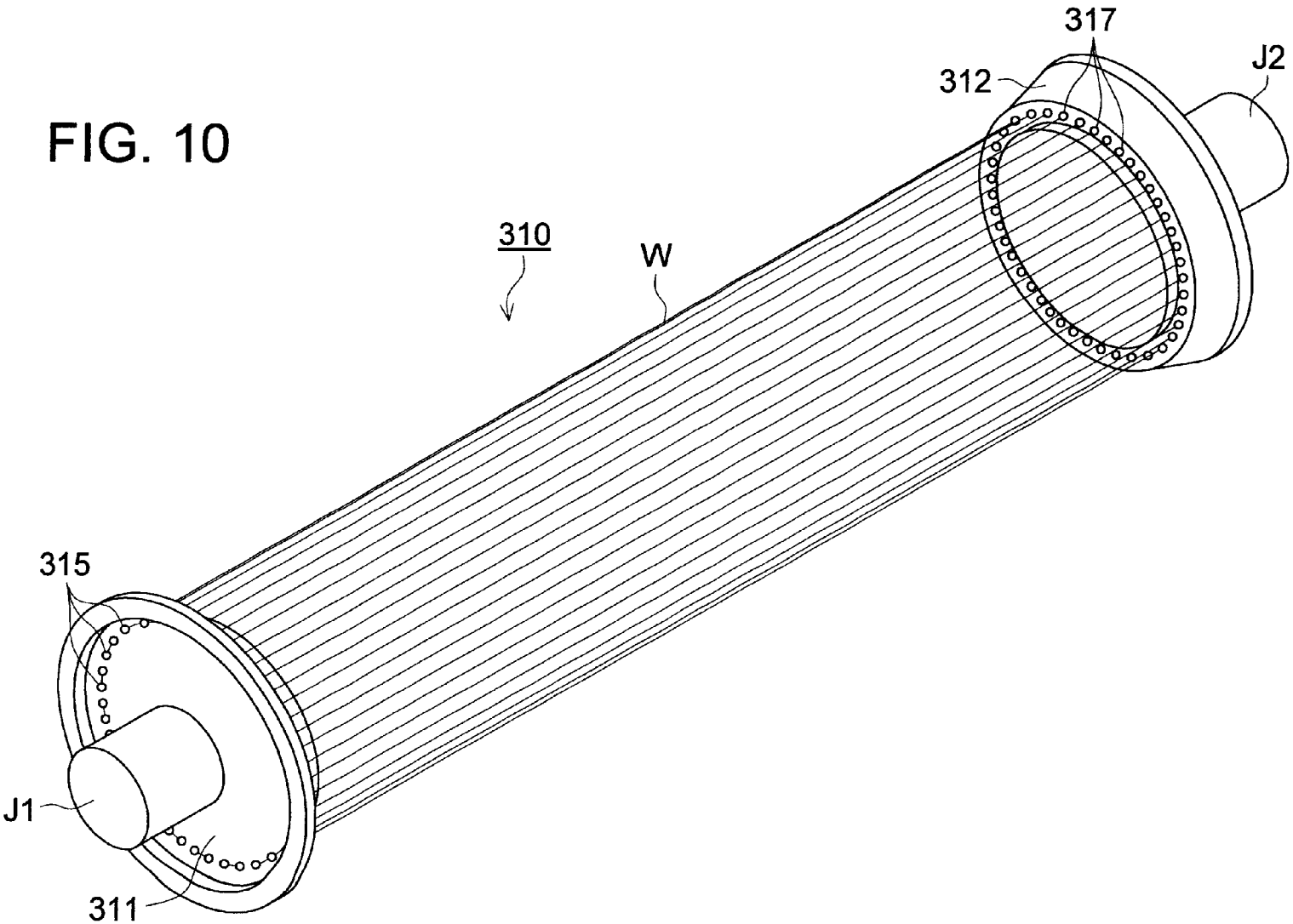
FIG. 10 is a conceptual diagram representing the configuration of the first backup roller, particularly, showing how wire is stretched.

FIG. 10 is a conceptual diagram representing the configuration of the first backup roller, particularly, showing how wire is stretched.

In this drawing, numeral 311 denotes a left flange, 312 a right flange, J1 a shaft designed integrally with the left flange 311 for the purpose of setting this left flange 311 at a certain position of the frame (to be described later), and J2 a shaft designed integral with the right flange for the purpose of serving the same function as the J1.

As is apparent from the drawing, there is no shaft between the left and right flanges 311 and 312 which connects them into an integral body.

W denotes a wire stretched between the left and right flanges 311 and 312. The wire is stretched approximately parallel on a concentric circle with the center of these flanges at a certain interval.

In this embodiment, many small holes 315 and 317 are provided at an equally spaced interval in the circumstantial direction of a circle with a certain diameter at the shaft center, and one end of the wire, for example, is fixed on the aforementioned left flange 315 with a screw. Then the other end is passed through one of the small holes. It is passed through a small hole of the right flange 312, and is folded back through the adjacent small hole. Then it is passed through the small hole of the left flange located on the same angle (which indicates correspondence of small hole positions). These steps are repeated, and in the final stage, the other end of the wire is fixed onto any one of the flange with a screw, whereby a basket type first backup roller can be obtained upon completion of assembling.

In the aforementioned embodiment, the right and left flanges are made integral by a wire. Before this time, they are handled independently of each other. When the wire is installed, it is important that the distance between two flanges is maintained at a specified value using a proper jig, and they are fixed in position before starting the work.

When the first backup roller is assembled in the frame of the fixing unit, the flange position is managed to ensure that a specified tension will be applied, or tension is given by a spring or the like.

As the material for the aforementioned wire W, a certain effect can be gained from such a metallic wire as steel wire. Better effects can be gained by using plastic fiber materials characterized by great strength, high heat resistance, low heat conductivity, low specific heat and low degree of elongation. For example, aromatic polyamide is suited for use.

In this embodiment, the fixing belt 300 having a peripheral length of 314 mm, width of 320 mm and tension of not more than 20 to 30 N (newton) is used 400-denier aromatic polyamide fiber, and tension of 20 to 30N is applied each of 24 wires W installed (the number of wires in the circumferential direction of the flange) and wires are fixed in position, whereby the first backup roller 310 equivalent to a diameter of 30 mm is formed.

It is preferred that the number of the aforementioned wires W be 8 to 30, the size of wire W be 100 to 1000 deniers, and the tension of wire W be 10 to 50N (newton).

One wire W can be laid back and forth a required number of times, as described above, or multiple wires W can be laid between flanges 311 and 312. It allows an extensive range of designing flexibility.

Figure 11:
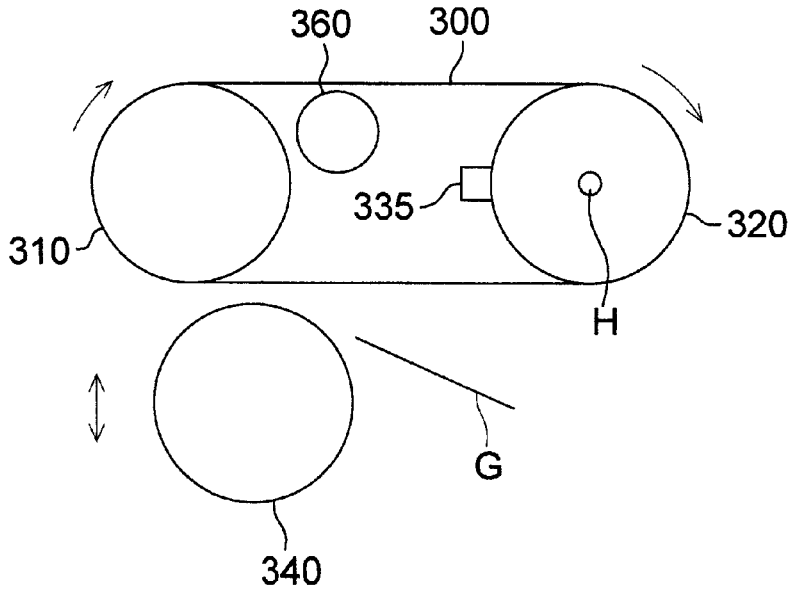
FIG. 11 is a schematic diagram representing only the configuration of the fixing unit as a Second Embodiment of the present invention.

FIG. 11 is a schematic diagram representing only the configuration of the fixing unit as a Second Embodiment of the present invention.

The same numerals of reference are assigned to the same members (means) as those mentioned above or the members having the same functions.

The fixing unit 30 shown in the drawing can be used as the fixing unit of the image forming apparatus shown in FIG. 11. The configuration of the fixing belt, the temperature control of the fixing belt and the configuration and control of the second pressure roller are basically the same as those mentioned above. So their description will be omitted to avoid duplication, wherever possible, and only the differences will be described.

In the drawing, the first backup roller 310 and second backup roller 320 where the fixing belt 300 is applied to form a loop have the functions different from those of the corresponding backup roller, for example, shown in FIG. 8.

Namely, in the process of fixing, the first backup roller 310 according to the present embodiment moves above the second pressure roller 340 provided face-to-face with the aforementioned fixing belt 300, and provides contact pressure and gripping force in cooperation with the aforementioned second pressure roller through the aforementioned fixing belt 300. It can be said to have part of the functions of the first pressure roller 330, in addition to the function of the first backup roller 310 in the first embodiment. However, the heat source is not incorporated.

The second backup roller 320 incorporates a heat source H which is controlled in such a way that the surface temperature of the aforementioned fixing belt 300 is raised to a fusible temperature.

The temperature detecting sensor 335 detects the surface temperature of the aforementioned second backup roller 320 and the control means S (FIG. 1) controls the power of the aforementioned heat source according to the information on detected temperature.

As described above, the second backup roller 320 has a function of a heating means for the fixing belt, in addition to the functions of the second backup roller 320 in the first embodiment.

Numeral 360 denotes a temperature-equalizing means for rollers (hereinafter referred to as "temperature-equalizing roller") which is installed in the loop formed by the aforementioned fixing belt 300. It is normally held at a position separated (released) from the inner surface of the aforementioned fixing belt. Under special conditions, it moves upwards and is pressed against the inner surface of the aforementioned fixing belt to be driven in conformity to the fixing belt movement.

Figure 12:
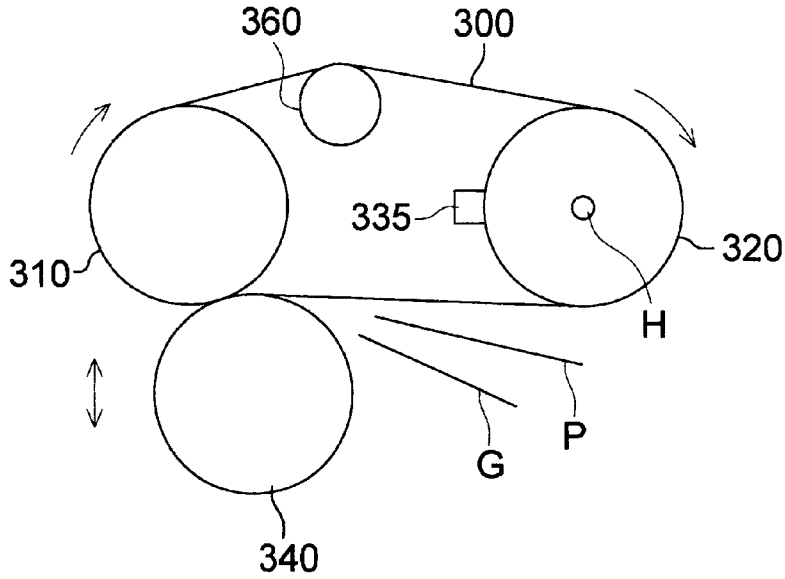
FIG. 12 is a drawing representing the positional relationship between the temperature-equalizing roller and fixing belt in the fixing process of small-sized paper.

FIG. 12 is a drawing representing the positional relationship between the temperature-equalizing roller and fixing belt in the fixing process of small-sized paper The mechanism of driving the aforementioned second pressure roller 340 and the aforementioned temperature-equalizing roller 360 can be realized by a known method.

The aforementioned temperature-equalizing roller 360 is a solid roller made of a metal having a high heat conductivity exemplified by aluminum. It has almost the same size as the fixing/heating width of the fixing belt (a fixable width; a dimension in the direction intersecting at right angles to the direction of movement on the fixing belt).

In other words, it has the portion of the roller in contact with the entire area (overall length) in the direction of heating width of the aforementioned fixing belt 300.

Paper P having the size with transferred toner image, for example, A4-sized paper is fed in the longitudinal direction. When it reaches the aforementioned fixing unit 30 and passes between the second pressure roller 340 and fixing belt 300 placed above, it receives pressure generated by the first backup roller 300 and the aforementioned second backup roller 320 and heat from the aforementioned fixing belt 300, and the aforementioned toner image is fixed on the aforementioned paper P. Then paper is ejected out of the machine.

In this case, the temperature-equalizing roller 360 is held at a position detached from the inner surface of the aforementioned fixing belt 300.

In the meantime, when paper P (e.g. B5-sized paper) has a width smaller than width to be fixed and heated, the aforementioned temperature-equalizing roller 360 is fed upward to come into contact with the inner surface of the aforementioned fixing belt. Upon completion of fixing, it is fed back downward and the contact under pressure is released by the control means S.

As a result of the above steps, the heat in the area (paper feed area) above the fixing belt 300 corresponding to the direction of the width of the aforementioned paper P is used for fixing a toner image. For example, heat on the non-paper feed area formed on both sides across the width is shifted toward the inner side across the width by the aforementioned temperature-equalizing roller 360, namely, it is shifted from the non-paper feed area to the paper feed area, uniform distribution of temperature is ensured on the fixing belt, with the result that deposition of heat in the non-paper feed area is released.

In other words, despite continuous fixing process of small-sized paper P, shift of heat through the temperature-equalizing roller 360 reduces the difference of temperatures between the area on the fixing belt corresponding to the paper feed area and that on the fixing belt corresponding to the non-paper feed area. There is no excessive heat accumulated on the fixing belt corresponding to the non-paper feed area.

This makes it possible to avoid uneven fixing on the paper mentioned above, despite subsequent fixing of large-sized paper.

Further, shift of heat by the mediation of a temperature-equalizing roller, for example, allows the intervals of power supply to the heat source to be expanded, thereby improving the energy efficiency.

Further, the durability of the fixing belt is ensured because uniform thermal load on the fixing belt.

When the temperature-equalizing member is brought in contact from the outside of the fixing belt, temperature of the temperature-equalizing member is raised by the contact of the belt. Upon completion of fixing operation thereafter, the heat of the temperature-equalizing member flows outside through the housing. By incorporation into the belt as in the present invention, the belt is also made to serve as a heat insulating member, thereby reducing the amount of heat to be discharged, and ensuring a high energy efficiency.

The distinction between small and large sizes of the paper can be determined as required. For example, the smallest size used in an forming system (in the direction of the width to be fixed heated in the fixing belt) can be defines as a small size, while a size greater that can be defined as a large size.

In the continuous processing of multiple sheets of small-sized paper, the time ofixing the temperature-equalizing roller can be determined according to the size of paper and number of sheets subjected to continuous treatment, when using a fixing unit where the difference of temperatures between the area on the fixing belt corresponding to the paper feed area and that on the belt corresponding to the non-paper feed area.

The aforementioned temperature-equalizing roller based on the size of paper to be used is operated according to the information on the input paper size or information from a known paper size detecting means which is put into the control means S.

The configuration of the fixing unit serving also as a temperature-equalizing roller is not restricted to the configuration shown in the drawing. It is also possible to make arrangements in such a way that the substrate of the fixing belt is made of metallic substance, and the aforementioned metallic surface and temperature-equalizing roller are brought in contact.

Further, the temperature-equalizing means is not restricted to the roller-shaped one. For example, it can be made of a material semi-circular in cross section with a high heat conductivity, where the circular arc portion is brought into contact with the inner surface of the belt when in use, and it is fixed and held at that position.

Reduced warming up time and improved energy efficiency are provided according to the Second Embodiment of the present invention.

According to the Second Embodiment of the present invention, improved energy efficiency and uniform surface temperature of the fixing belt can be provided, despite the fluctuation in the size of the paper to be fixed.

[Third Embodiment]

Figure 13:
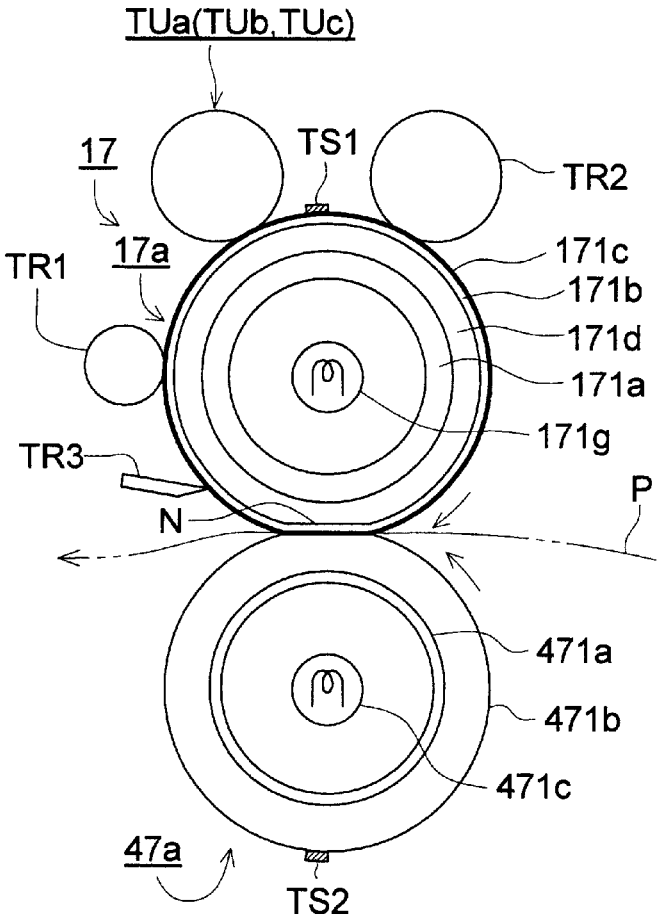
FIG. 13 is an illustration representing the structure of a fixing unit.

The fixing unit 17 according to the Third Embodiment comprises a fixing roller 17*a* for fixing the color toner image and a pressure roller 47*a* installed face-to-face with the fixing roller 17*a*, as shown in FIG. 13. A halogen lamp 171*g* and xenon lamp (not illustrated) as heating means for light irradiation are installed at the center inside the fixing roller 17*a*. The fixing roller 17*a* is provided with a fixing temperature-equalizing roller unit TUa (a temperature-equalizing roller unit group TUb as a temperature-equalizing unit member having a temperature-equalizing roller, or a temperature-equalizing roller unit group TUc as a temperature-equalizing unit member having a temperature-equalizing roller) as a temperature-equalizing unit member equipped with a temperature-equalizing roller.

The recording paper P is clamped and held at a nip portion N formed between fixing roller 17*a* and pressure roller 47*a*. When heat and pressure are applied, the color toner image on the recording paper P is fixed and the recording paper P is fed by the paper eject roller 18 to be ejected to the tray located on the upper portion of the system.

According to FIG. 13, the fixing unit 17 comprises an elastic fixing roller 17*a* for fixing the toner image on the transfer material and a pressure roller 47*a* installed face-to-face with fixing roller 17*a*. Recording paper P is gripped at the nip portion N having a width of 5 to 20 mm formed between the elastic fixing roller 17*a* and pressure roller 47*a*. When heat and pressure are applied, the image on the recording paper P is fixed. The fixing roller 17*a* for fixing the toner image is provided with a fixing separation jaw TR3, cleaning roller TR1, fixing temperature-equalizing roller unit TUa (a temperature-equalizing roller unit group TUb as a temperature-equalizing unit member having a temperature-equalizing roller, or a temperature-equalizing roller unit group TUc as a temperature-equalizing unit member having a temperature-equalizing roller) and oil coating roller TR2; these parts are arranged from the nip portion N toward the direction where the fixing roller 17*a* rotates. Oil is painted to the fixing roller 17*a* by the oil coating roller TR2 consisting of a felt member impregnated with oil wound on the cylindrical aluminum pipe or paper tube. Toner and oil are removed from the circumferential surface of the fixing roller 17*a* by the cleaning roller TR1. The transfer material subsequent to fixing is removed by the fixing separation jaw TR3. As will be described later, the fixing temperature-equalizing roller provided on the fixing temperature-equalizing roller unit TUa or temperature-equalizing roller unit group TUb ensures a uniform temperature distribution on the light absorbing layer 171*b* on the circumferential surface of the fixing roller 17*a* heated by the halogen lamp 171*g* as a heating means or xenon lamp (not illustrated). Especially, uneven temperature in the lateral direction of the fixing roller 17*a* resulting from the passing of transfer material is made uniform.

A fixing roller 17*a* for fixing a toner image on the transfer material is arranged as a soft roller having an outer diameter of 25 to 50 mm comprising (1) a transparent base body 171*a* as a cylindrical substrate, (2) a translucent elastic layer 171*d* as an elastic layer on the outer surface of the aforementioned transparent base body 171*a*, and (3) a light absorbing layer 171*b* outside (on the outer surface of) the aforementioned translucent elastic layer 171*d* or (4) a mold release layer 171*c* provided outside (on the outer surface of) the light absorbing layer 171*b*, as required. A halogen lamp 171*g* as a heating means for irradiating light as a light source and a xenon lamp (not illustrated) are installed at the center inside the transparent base body 171*a*. The fixing roller 17*a* is designed as a highly elastic soft roller, as will be described later. It forms a fixing roller member which permits quick heating by the light issued from the halogen lamp 171*g* and xenon lamp (not illustrated) is absorbed by the light absorbing layer 171*b*.

Further, the pressure roller 47*a* provided face-to-face with the fixing roller 17*a* is designed as a soft roller having an outer diameter of 25 to 50 mm consisting of a rubber roller 471*b* formed of a rubber material layer with a rubber hardness of 10 to 40 Hz (rubber hardness in conformity to JIS A) having a thickness of 2 to 7 mm, for example, using the cylindrical metallic pipe 471*a* made of aluminum material where silicone material, for example, is used on the outer surface of the aforementioned metallic pipe 470*a*. A highly heat insulating elastic rubber roller is used as a pressure roller to prevent heat from dissipating from the fixing roller member to the pressure roller member. At the same time, it is intended to ensure a greater nip width. As required, a halogen lamp 471*c* may be installed as a heating means at the center inside the metallic pipe 471*a*.

A flat nip portion N is formed between the fixing roller 17*a* formed as a soft roller and a pressure roller 47*a* also formed as a soft roller, and the toner image is fixed.

The TSI is a temperature sensor as a temperature detecting means using a contact type thermistor mounted on the fixing roller 17*a* for temperature control. TS2 is a temperature sensor using, for example, a contact type thermistor for temperature control mounted on the roller 47*a*. As temperature sensors TS1 and TS2, a non-contact type using a infrared sensor, for example, can be used in addition to the contact type.

Figure 14:
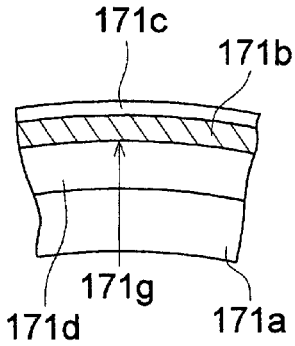
FIG. 14 is an enlarged cross sectional view representing a fixing roller member.

As the cross section is shown in FIG. 14, a transparent base body 171*a* of the fixing roller 17*a* is mainly composed of the glass member for allowing the light coming from the halogen lamp 171*g* and xenon lamp (not illustrated) to pass by, for example, pyrex glass, sapphire ($Al_2O_3$), such ceramic material as $CaF_2$ (with a heat conductivity of (5 to 20)$\times10^{-1}$ W/m.K, specific heat (0.5 to 2.0)$\times10^3$ J/kg.K, specific weight of 1.5 to 3.0), wherein the aforementioned glass member has a thickness of 0.5 to 5 mm, preferably, 0 to 3 mm. It is also possible to use the translucent resin (with a heat conductivity of (2 to 4)$\times10^{-1}$ W/m.K, specific heat of (1 to 2)$\times10^3$J/kg.K, specific weight of 0.8 to 1.2) composed ofixing polyimide, polyamide, etc. As described above, the transparent base body 171*a* does not show excellent heat conductivity.

The translucent elastic layer 171*d* as an elastic layer uses a silicone rubber or fluorine rubber having a thickness of 0.5 to 5 mm, preferably, 1 to 3 mm, and is formed of a translucent silicone rubber layer or fluorine rubber layer (base layer). To meet the requirements for high speed, the translucent elastic layer 171*d* is blended with metallic oxide powder such as silica, alumina and magnesium oxide as a base layer to improve heat conductivity. The silicon layer and fluorine rubber layer used has a conductivity of (1 to 3)$\times10^{-1}$W/m.K, specific heat of (1 to 2)$\times10^3$J/kg.K, specific weight of 0.9 to 1.0. The heat conductivity of the silicone rubber layer or fluorine rubber layer is lower than that of the transparent base body 171*a* (heat conductivity of (5 to 20)$\times\mathbf{10}^{-1}$W/m.K), so this layer serves as a heat insulating layer. If heat conductivity is increased, rubber hardness tends to increase generally. For example, the rubber with a normal hardness of 40 Hs will have close to 60 Hs (rubber hardness in conformity to JIS A). Preferred rubber hardness is 10 to 50 Hs. The greater part of the translucent elastic layer 171*d* of the fixing roller member is occupied by the base layer, the amount of compression under pressure is determined by the rubber hardness of the base layer. The intermediate layer of the translucent elastic layer 171*d* is coated with fluorine based rubber as a oil resistant layer preferably to a thickness of 20 to 300 microns in order to prevent oil from swelling. The wavelength of the light passing through the translucent elastic layer 171*d* is 0.1 to 20 microns, preferably 0.3 to 3 microns, so the translucent elastic layer 171*d* may be formed by dispersing over the resin binder the particulates of such metallic oxides as translucent titanium oxide, aluminum oxide, zinc oxide, silicon oxide, magnesium oxide and potassium carbonate having a particle size of one half the wavelength of light, preferably less than one fifth, with an average size of particles including the primary and secondary particles being 1 micro or less, preferably, 0.1 microns or less, as the feeler used as a regulating agent for the aforementioned hardness and heat conductivity. An average size of particles including the primary and secondary particles being 1 micro or less, preferably, 0.1 microns or less in the layer is preferred to prevent light from being scattered and to allow the light to reach light absorbing layer 171*b*. Installation of a translucent elastic layer 117*d* allows the fixing roller 17*a* to be formed as a highly elastic soft roller.

The light absorbing layer 171*b* is formed by using the resin binder blended with about 10 wt % powder of carbon black, graphite, black iron ($Fe_3O_4$) or various ferrites and their compound, copper oxide, cobalt oxide and rouge ($Fe_2O_3$) as light absorbing member. This is intended to allow a fixing roller member capable of quick heating to be formed by absorbing through the light absorbing layer 171*b* the light which is emitted from the halogen lamp 171*g* and xenon lamp (not illustrated) and absorbed the transparent base body 171*a* and translucent elastic layer 171*d*, and which is 90 to 100% corresponding to about 100% of the light having passed through the transparent base body 171*a* and translucent elastic layer 171*d*, or preferably 95 to 100%. The light absorbing layer 171*b* having a thickness of 25 to 200 microns, preferably, 30 to 150 microns is sprayed or coated to the outside (on the outer surface) of the translucent elastic layer 171*d* for formation. Addition of such absorbent as carbon black allows the heat conductivity of the light absorbing layer 171*b* to be set to ((3 to 100)$\times10^{-1}$W/m.K)—a value slightly higher than that of the base layer of the aforementioned translucent elastic layer 171*d* (a heat conductivity of (3 to 10)$\times10^{-1}$W/m.K). The specific heat of the light absorbing layer 171*b* is (up to 2.0)$\times10^3$J/kg.K and the specific weight is up to 0.9.

As an specific example of the aforementioned fixing roller member, the fixing roller 17*a* having an outer diameter of about 30 mm is used, wherein this roller comprises (1) a transparent base body 171*a* made of pyrex glass (made by Corning Incorporated, USA) having an outer diameter of 27 mm and a layer thickness of 0.6 mm, (2) a translucent elastic layer 171*d* made of transparent silicone rubber with a layer thickness of 1.5 mm, and (3) a light absorbing layer 171*b* covered with the PFA tube with carbon dispersed having a layer thickness of 30 microns.

The aforementioned fixing unit is characterized by excellent resistance against deformation on the fixing portion (nip portion) and by the capability of quick start (quick heating). Quick start (quick heating) fixing of color toner is provided by soft pressure at the fixing portion (nip portion) due to the elastic fixing roller member and heating by the light absorbing layer of the aforementioned fixing roller member. Furthermore, energy saving effect is also provided.

Figure 15:
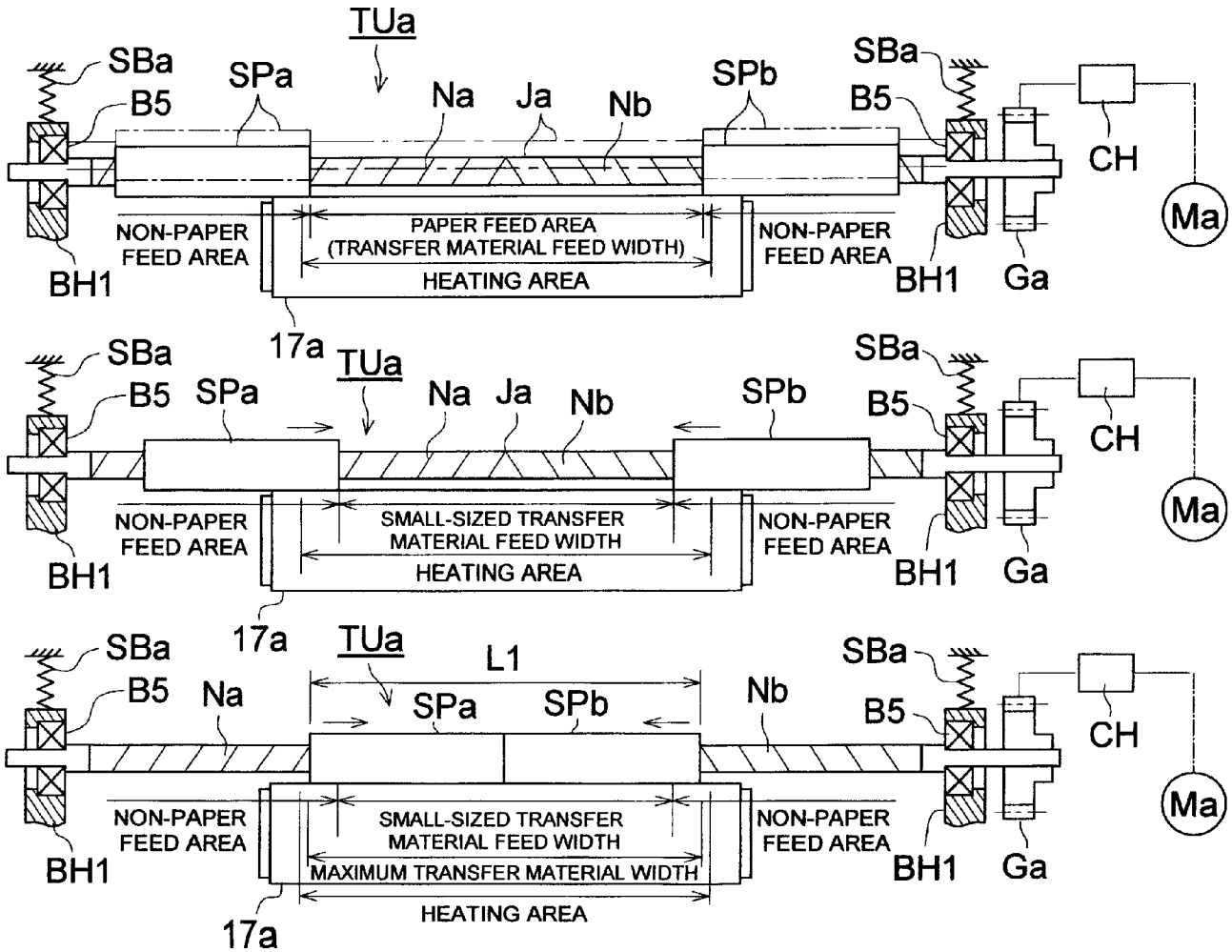
FIG. 15(A), FIG. 15(B) and FIG. 15(C) are drawings representing a first example of the configuration of a temperature-equalizing roller.
Figure 16:
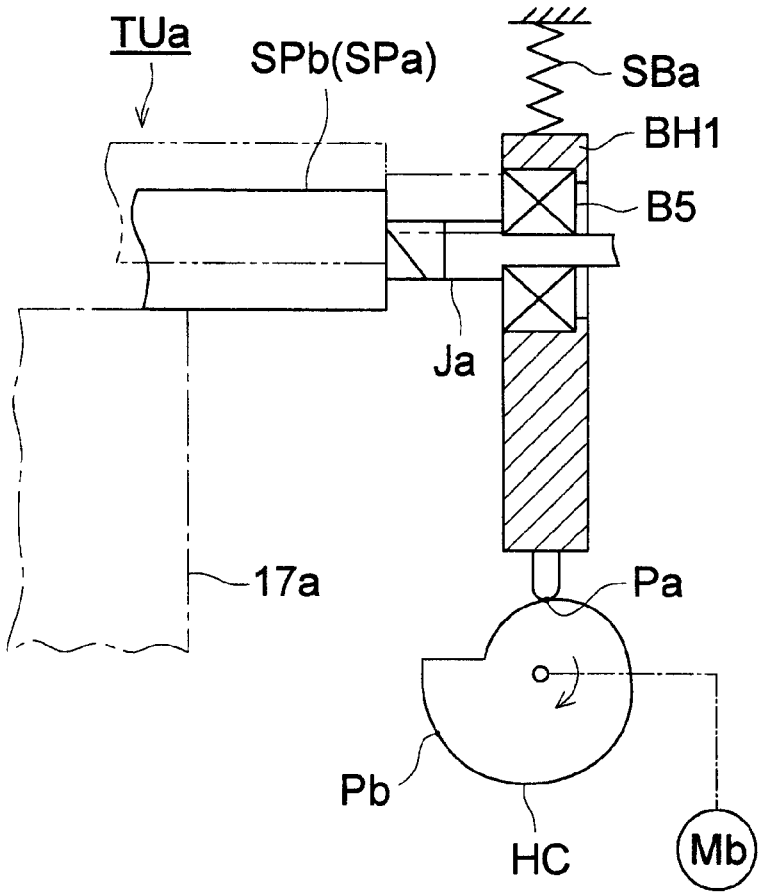
FIG. 16 is a drawing representing the mechanism of pressing the temperature-equalizing roller and releasing it.
Figure 17:
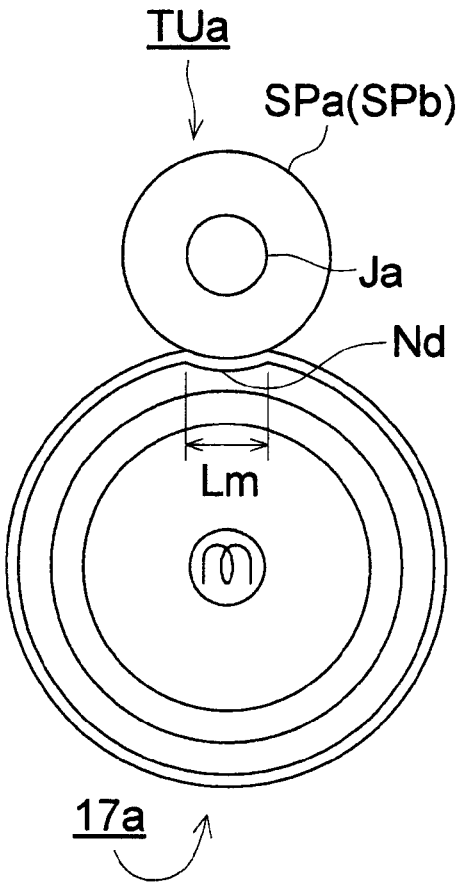
FIG. 17 is a drawing representing the nip width between the temperature-equalizing roller and fixing roller in the axial direction.
Figure 18:
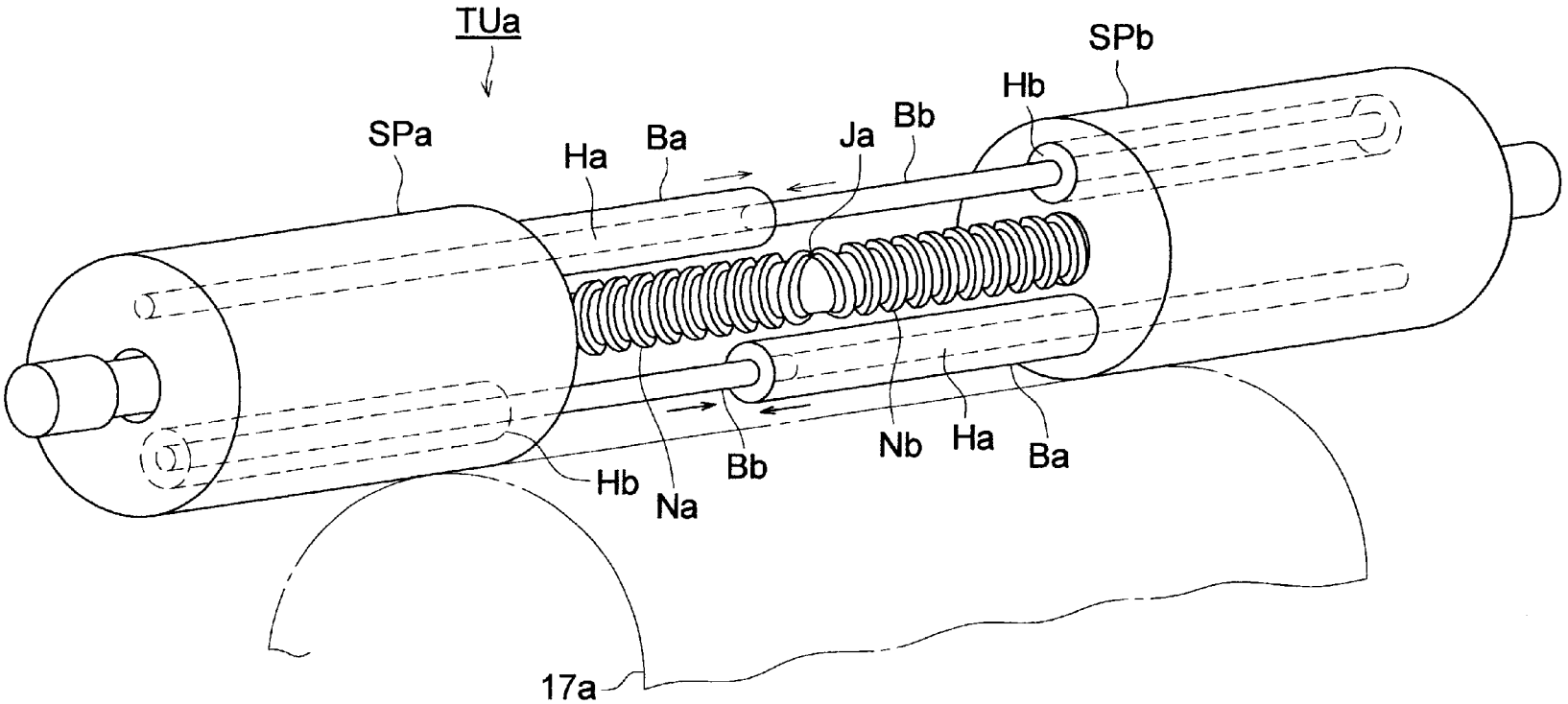
FIG. 18 is a drawing representing a phase deviation preventive member provided on the temperature-equalizing roller in FIG. 15(A), FIG. 15(B) and FIG. 15(C)

With reference to the FIGS. 15(A) to 18, the following describes the first example of the temperature-equalizing unit member equipped with a temperature-equalizing roller for raising the temperature at the end of the fixing roller member even during continuous feed of the small-width transfer material by making an effective use of the heat dissipation of the fixing roller member, without affecting the preheating time of the fixing unit. FIG. 15(A), FIG. 15(B) and FIG. 15(C) are drawings representing a first example of the configuration of a temperature-equalizing roller. FIG. 16 is a drawing representing the mechanism of pressing the temperature-equalizing roller and releasing it. FIG. 17 is a drawing representing the nip width between the temperature-equalizing roller and fixing roller in the axial direction. FIG. 18 is a drawing representing a phase deviation preventive member provided on the temperature-equalizing roller shown in FIG. 15(A), FIG. 15(B) and FIG. 15(C).

According to FIGS. 15(A) to 17, in order to ensure uniform temperature on the surface of the fixing roller 17*a* as a fixing roller member, the fixing roller 17*a* is provided with a fixing temperature-equalizing roller unit TUa capable of pressing and release of pressing as a temperature-equalizing unit member, as shown in FIG. 15(A), FIG. 15(B) and FIG. 15(C).

The fixing temperature-equalizing roller unit TUa consists of a temperature-equalizing roller rotary shaft Ja threaded (e.g. M6) over almost the entire length, and two temperature-equalizing rollers comprising; (1) a first contact pipe SPa as a left temperature-equalizing roller consisting of an aluminum pipe having an outer diameter of, for example, 25 mm, which is fitted (screwed) to the temperature-equalizing roller rotary shaft Ja in the relationship of internal and external screws, and (2) a second contact pipe SPb as a right temperature-equalizing roller similarly consisting of an aluminum pipe having an outer diameter of 25 mm.

The thread formed on the temperature-equalizing roller rotary shaft Ja is composed of a threaded portion Na and threaded portion Nb which have a different direction of threading with each other (namely, threads on the threaded portion are formed in the different direction) approximately at the center of the paper feed area (paper feed width of the transfer material). The first contact pipe SPa is meshed with the threaded portion Na, and the second contact pipe SPb is meshed with the threaded portion Nb. The temperature-equalizing roller rotary shaft Ja is held rotatably by the bearing B5 embedded in the bearing holder BH1 provided on both ends. The bearing holder BH1 provided on both ends is pressed by respective pressing springs SBa, and two temperature-equalizing rollers consisting of the first contact pipe SPa and second contact pipe SPb are pressed against the fixing roller 17*a*. The gear Ga provided on one end of the temperature-equalizing roller rotary shaft Ja is connected with the temperature-equalizing roller rotary shaft drive motor Ma through the drive system (not illustrated) including the clutch CH, and the temperature-equalizing roller rotary shaft Ja is driven by the temperature-equalizing roller rotary shaft drive motor Ma. The drive speed of the temperature-equalizing roller rotary shaft drive motor Ma is variable, and the speed of temperature-equalizing roller rotary shaft Ja is made variable. When the clutch CH is engaged, the temperature-equalizing roller rotary shaft Ja is driven. When the clutch CH is not engaged, the temperature-equalizing roller rotary shaft Ja is not driven.

In the initial state, the first contact pipe SPa and second contact pipe SPb as temperature-equalizing rollers are located on both sides of the temperature-equalizing roller rotary shaft Ja, as shown in FIG. 15(A). The clutch CH is disengaged to ensure that the temperature-equalizing rollers will be driven at the fixed position on both sides, and temperature-equalizing rollers have the same peripheral speed with the fixing roller 17*a* to ensure that respective temperature-equalizing rollers are driven at the fixed position following the rotation of the fixing roller 17*a*.

As shown by the one-dot chain line in FIG. 15(A), when the fixing roller 17*a* is preheated, the fixing temperature-equalizing roller unit TUa is detached from the fixing roller 17*a* (with pressing released), and is held in position. If the feed width of the transfer material to be fixed is approximately the same as the heated area after the fixing operation mode has started (e.g., in the case of the width of A3-sized paper fed in the longitudinal direction (297 mm) if the transfer material has a large-sized width), similar detachment (pressing released) occurs, without fixing operation being involved.

In the arrangement of pressing the temperature-equalizing roller and releasing it, for example, the bearing holder BH1 for holding the temperature-equalizing roll rotary shaft Ja is pressed, and the first contact pipe SPa and second contact pipe SPb are pressed against the fixing roller 17*a*, as shown in FIG. 16. An eccentric cam HC for moving the bearing holder BH1 along the guide member (not illustrated) against pressure (contact pressure) of the spring SBa is installed on the side opposite to the pressing spring SBa. The eccentric cam HC is moved from the lower fulcrum Pa to the upper fulcrum Pb in the pressed state by the rotation of the eccentric cam drive motor Mb. The first contact pipe SPa and second contact pipe SPb are detached from the fixing roller 17*a*. Pressing and release of pressing are provided by the forward and reverse rotation of the eccentric cam drive motor Mb.

Rotation of the eccentric cam HC by the eccentric cam drive motor Mb is stopped at multiple positions between the lower fulcrum Pa and the upper fulcrum Pb, and contact pressure of the first contact pipe SPa and second contact pipe SPb against the fixing roller 17*a* in the state shown in each of FIG. 15(A), FIG. 15(B) and FIG. 15(C) can be selected from multiple values. Control is so made that the contact pressure of the first contact pipe SPa and second contact pipe SPb against the fixing roller 17*a* is increased or decreased in conformity to the contact width of the first contact pipe SPa and second contact pipe SPb against the fixing roller 17*a* in the axial direction (contact width in the axial direction should be reduced in the case of larger transfer material feed width, and should be reduced in the case of smaller transfer material feed width). As shown in FIG. 17, this accurately ensures the width Ln (contact width in the direction intersecting with the shaft) of the equalization roller nip portion Nd in the direction where shafts intersects at right angles with the shaft between the first contact pipe SPa and second contact pipe SPb of the fixing temperature-equalizing roller unit TUa, and the fixing roller 17*a*. For selection of the contact pressure, the known method such as a combination of cam mechanism with multiple stop positions and spring can be used.

When the feed width of transfer material to be fixed is small with respect to the heating area of the fixing roller 17*a*, the first contact pipe SPa and second contact pipe SPb are pressed against the fixing roller 17*a*, as shown in FIG. 15(B), and the clutch CH is engaged. The speed of the temperature-equalizing roller rotary shaft Ja driven by the temperature-equalizing roller rotary shaft drive motor Ma is increased or decreased with respect to the normal speed (the speed where clutch CH is engaged and each temperature-equalizing roller is driven following the rotation of the fixing roller 17*a*). Since the first contact pipe SPa and second contact pipe SPb are pressed against the fixing roller 17*a*, the drive speed of the first contact pipe SPa and second contact pipe SPb is determined by the speed of the fixing roller 17*a*, following the fixing roller 17*a*. The clutch CH is engaged, and relative rotation of the temperature-equalizing roller rotary shaft Ja, and the first contact pipe SPa and second contact pipe SPb are caused by the increase or decrease of the temperature-equalizing roller rotary shaft drive motor Ma. Then the first contact pipe SPa and second contact pipe SPb are mutually moved toward the inner side on the temperature-equalizing roller rotary shaft Ja in conformity to the small-sized transfer material feed width (e.g. A4-size longitudinal feed width (210 mm)). When the first contact pipe SPa and second contact pipe SPb have reached the non-paper feed area of the fixing roller 17*a*, the clutch CH is disengaged and each temperature-equalizing roller can rotate at a fixed position, following the rotation of the fixing roller 17*a*. A combination between the acceleration and deceleration of the temperature-equalizing roller rotary shaft Ja and the traveling direction of the first contact pipe SPa and second contact pipe SPb as two temperature-equalizing rollers is determined by the direction of the thread, and either of them can be selected. The positions of the first contact pipe SPa and second contact pipe SPb (positions where the same peripheral speed as that of the fixing roller 17*a* is achieved) can be detected by a position sensor (not illustrated) or the like. The rate of acceleration and deceleration of the temperature-equalizing roller rotary shaft Ja and time can be used for control.

The first contact pipe SPa and second contact pipe SPb remove extra heat from the non-paper feed area from the fixing roller 17*a*, and heat is stored on the first contact pipe SPa and second contact pipe SPb and the temperature-equalizing roller rotary shaft Ja. When the number of prints to be fixed is small, the first contact pipe SPa and second contact pipe SPb are placed at a position separate from the fixing roller 17*a*, upon completion of the operation. The heat stored on the first contact pipe SPa and second contact pipe SPb is discharged naturally.

When the temperature of the first contact pipe SPa and second contact pipe SPb is raised by printing of multiple small-sized transfer material in the continuous or intermittent fixing process, the efficiency of removing extra heat from the fixing roller 17*a* will be reduced. When the temperature of the first contact pipe SPa and second contact pipe SPb has risen to a certain level, each of the first contact pipe SPa and second contact pipe SPb is moved inside by the acceleration and deceleration of the temperature-equalizing roller rotary shaft Ja, as shown in FIG. 15(C), in order to ensure that the first contact pipe SPa and second contact pipe SPb contact the entire heating area of the fixing roller 17*a*. In order to secure the contact width (the width Ln of equalization roller nip portion Nd previously described with reference to FIG. 17 (width in the direction of intersecting the shaft)) in the transfer material feed direction (when only the end is pressed as described with reference to FIG. 15(A), load of two temperature-equalizing rollers on the fixing roller 17*a* is preferred to be set to a smaller value, so the contact pressure of two temperature-equalizing rollers by the arrangement of pressing and release of pressing described with reference to FIG. 16 is set at a smaller value), the contact pressure of two temperature-equalizing rollers is preferred to be set at a larger value by the arrangement of pressing and release of pressing described with reference to FIG. 16. The total length L1 (mm) of two temperature-equalizing rollers as the first contact pipe SPa and second contact pipe SPb is generally preferred to be set to the same value as the maximum width of the transfer material (maximum width of the transfer material: e.g. A3-size paper longitudinal feed width (297 mm)).

The contact pressure between two temperature-equalizing rollers and fixing roller 17*a* is controlled in conformity to contact width between the first contact pipe SPa and second contact pipe SPb, and the fixing roller 17*a* in the axial direction. So the contact pressure in the aforementioned FIG. 15(B) is preferred to set to a value greater than that in the aforementioned FIG. 15(A). Further, the contact pressure in the FIG. 15(C) is preferred to set to a value greater than that in the aforementioned FIG. 15(B).

The first contact pipe SPa and second contact pipe SPb transport heat from the non-paper feed area to the paper feed area in conformity to the difference of temperature from that of the fixing roller 17*a*, with the result that temperature of the fixing roller 17*a* is made uniform. Upon completion of fixing, the first contact pipe SPa and second contact pipe SPb are fed back to both ends of the fixing roller 17*a*. Then pressing between the fixing roller 17*a* and the first contact pipe SPa and second contact pipe SPb is released. Since the first contact pipe SPa and second contact pipe SPb are fed back to both ends of the fixing roller 17*a*, it is possible to prevent heat from being removed from the paper feed area by the contact with the fixing roller 17*a* when the first contact pipe SPa and second contact pipe SPb are moved next time.

As described above, the present embodiment allows contact pressure to be switched in order to ensure the contact width in the transfer material feed direction when the contact width of the temperature-equalizing roller in the axial direction is increased. Further, the threads formed on the temperature-equalizing roller rotary shaft and temperature-equalizing roller are used to move the temperature-equalizing roller of the temperature-equalizing unit member by changing the speed of the temperature-equalizing roller rotary shaft, and to change heat shift portion (heat diffused portion) subsequent to the temperature rise of the temperature-equalizing roller in conformity to the difference in width of the transfer material.

The aforementioned characteristics provide uniform nip width in the nip portions (equalization roller nip portions) of the fixing roller member and temperature-equalizing roller, and effective heat dissipation from the fixing roller member by the temperature-equalizing roller. Despite a simple configuration, these characteristics hold down temperature rise on the fixing roller member end in the continuous feed process for small-width transfer materials, without affecting the preheating time of the fixing unit, and provide an image forming apparatus equipped with a fixing unit capable of quick start and best suited to color image forming.

However, in the configuration of the temperature-equalizing unit member of the aforementioned fixing unit, the phases of two temperature-equalizing rollers (first contact pipe and second contact pipe) may be deviated due to a slight difference in slide with the fixing roller member, and temperature-equalizing roller positions (fixed positions) may become unsymmetrical. With reference to FIG. 18, the following describes the phase deviation preventive member formed on two temperature-equalizing rollers described above for preventing phases of two temperature-equalizing rollers from being deviated:

For example, a rod Ba with hole Ha and a rod Bb projecting from hole Hb are formed on the first contact pipe SPa and second contact pipe SPb of the fixing temperature-equalizing roller unit TUa, as shown in FIG. 18. A phase deviation preventive member is assumed to be the one for fixing the mutual phases of two temperature-equalizing rollers in contact with the fixing roller 17*a* and two temperature-equalizing rollers around temperature-equalizing roller rotary shaft Ja which rotates them.

The rod Bb formed on each of the first contact pipe SPa and second contact pipe SPb is set to be fitted into the hole Ha of rod Ba and the rod Ba is set to be fitted into the hole Hb in such a way that they can be be inserted and pulled out. Each rod Bb with the top end fitted into hole Ha is fitted into position using the hole Ha of rod Ba as a guide at the time of movement toward the center of the first contact pipe SPa and second contact pipe SPb by the rotation of the temperature-equalizing roller rotary shaft Ja. Each rod Ba is fitted inside using the hole Hb as a guide by further shift to the center of the first contact pipe SPa and second contact pipe SPb. While fixing the mutual position around the temperature-equalizing roller rotary shaft Ja, each of the first contact pipe SPa and second contact pipe SPb moves to the center, thereby preventing phase deviation of each other. As described with reference to FIG. 15(C), the total length L1 (mm) (see FIG. 15(C), not illustrated in FIG. 18) of the first contact pipe SPa and second contact pipe SPb as two temperature-equalizing rollers is generally preferred to be set to the same value as the maximum width of the transfer material (maximum width of the transfer material: e.g. A3-size paper longitudinal feed width (297 mm)).

The phase deviation preventive member is not restricted to a combination of the aforementioned rod and hole. It can be selected from various types.

Mutual phase deviation of the temperature-equalizing rollers can be prevented by the aforementioned arrangement. Contact is made at a fixed position of the temperature-equalizing rollers so that temperature-equalizing rollers will be symmetrical with each other with respect to the central position of the transfer material feed width.

The description of the embodiment with reference to FIGS. 15(A) to 18 is based on the arrangement that the transfer material passes at the approximate center of the fixing roller of the fixing unit. Even when the transfer material passes with one end of the fixing roller member as a reference, the same application is possible if the thread of the temperature-equalizing roller rotary shaft is cut in one direction, and the temperature-equalizing roller is provided opposite to the side where small-sized transfer material passes. Further, the material and size of the fixing roller member and temperature-equalizing roller are preferred to be selected as appropriate in conformity to the fixing capacity of the fixing unit to be applied and fixing temperature tolerance.

In the description of the embodiment with reference to FIGS. 15(A) to 18, a glass member is used as the substrate of the fixing roller member of the fixing unit, as described with reference to FIG. 14. The same effect can be obtained by using the fixing roller member with an elastic layer formed on the metallic core. The same effect can also be gained in the fixing unit where a thin-walled metallic pipe is used as a fixing roller member. In this case, to ensure a sufficient contact width between the fixing roller member and temperature-equalizing roller, it is preferred that an elastic member layer is provided on the surface of the temperature-equalizing roller.

Figure 20:
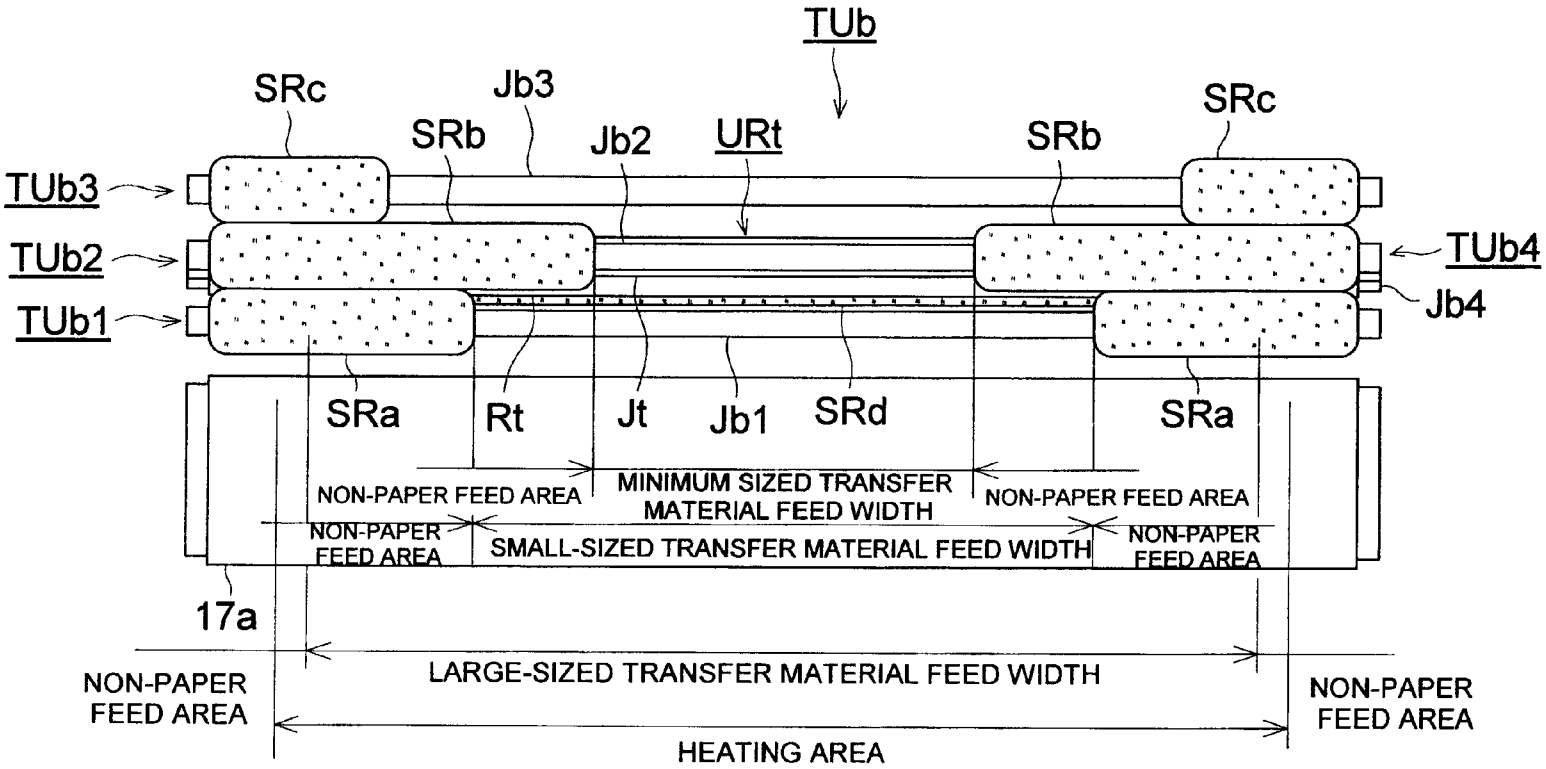
FIG. 20 is a schematic side view representing the temperature-equalizing roller member in FIG. 19(A) and FIG. 19(B)
Figure 21:
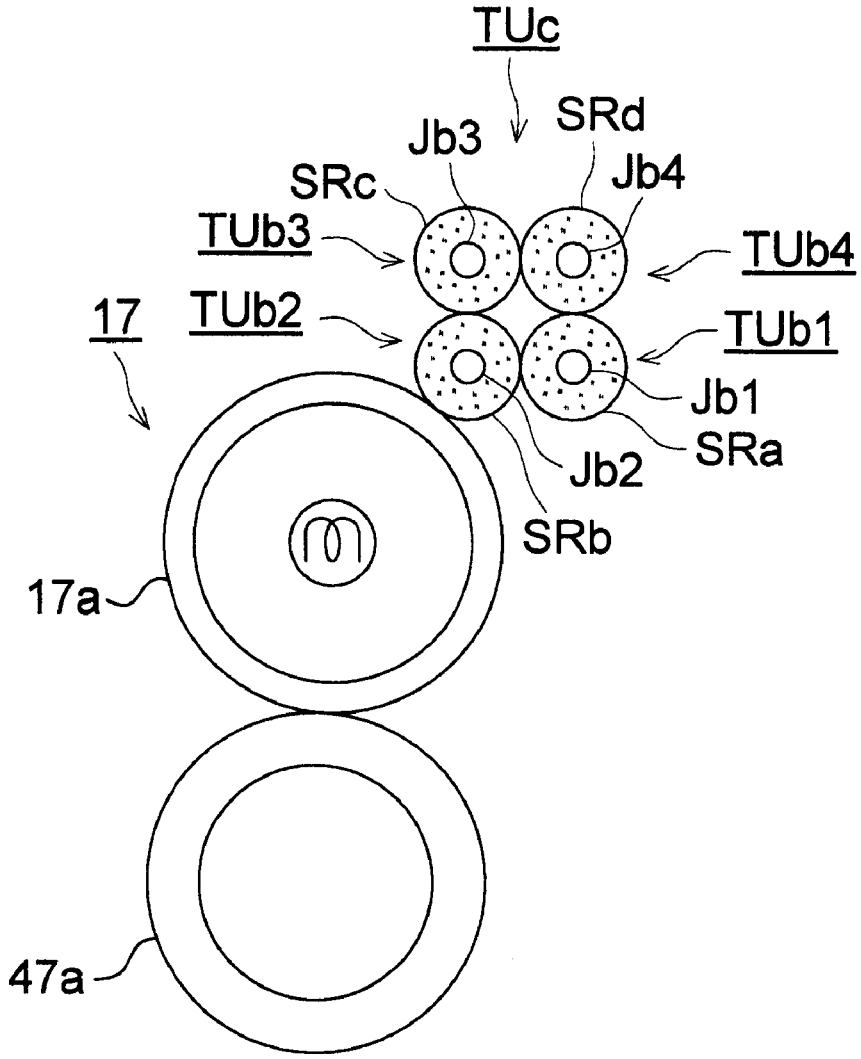
FIG. 21 is a drawing as a variation of FIG. 19(A) and FIG. 19(B)

The following describes the second example of a temperature-equalizing unit member comprising a temperature-equalizing roller with reference to FIGS. 19(A) to 21. FIG. 19(A) and FIG. 19(B) are drawings representing a second example of the configuration of a temperature-equalizing roller. FIG. 20 is a schematic side view representing the temperature-equalizing roller member shown in FIG. 19(A) and FIG. 19(B), and FIG. 21 is a drawing as a variation of FIG. 19(A) and FIG. 19(B).

According to FIG. 19(A), FIG. 19(B) or FIG. 20, the fixing unit 17 shown by each drawing in FIG. 19 is formed of the fixing roller 17*a* for fixing the toner image on the transfer material and pressure roller 47*a*, as described with reference to FIG. 13. To get a uniform temperature on the surface of the fixing roller 17*a* as a fixing roller member, the temperature-equalizing roller unit group TUb comprising the temperature-equalizing roller which allows selection between contact or non-contact to the fixing roller 17*a* is provided as a temperature-equalizing unit member, as shown in FIG. 19(A) and FIG. 19(B).

The temperature-equalizing roller unit group TUb comprises (1) a rotary shaft Jt composed of the aluminum material having an outer diameter of 12 mm located at the central position, (2) a center roller Rt as a roller member which covers the rubber layer used as a 1 mm-thick elastic body on the surface of the aforementioned rotary shaft Jt and which is kept in a non-contact state with the fixing roller 17*a*, (3) a rotary shaft Jb1 composed of the aluminum material having an outer diameter of 8 mm arranged around the aforementioned roller Rt, (4) a first temperature-equalizing roller unit TUb1 used as temperature-equalizing roller unit comprising contact rollers SRa on the right and left sides as temperature-equalizing rollers in contact with the aforementioned fixing roller 17*a*, which are fixed to the aforementioned rotary shaft Jb1, are composed of 2 mm thick rubber layers and have an outer diameter of 12 mm, (5) a rotary shaft Jb2 comprising the aluminum material with an outer diameter of 8 mm, (6) a second temperature-equalizing roller unit TUb2 which is composed of the aluminum material with an outer diameter of 12 mm fixed to or integral with the aforementioned rotary shaft Jb2 and which comprises contact rollers SRb on the right and left sides in contact with the aforementioned fixing roller 17*a*, (7) a rotary shaft Jb3 composed of the aluminum material having an outer diameter of 8 mm, (8) a third temperature-equalizing roller unit TUb3 which is composed of the aluminum material with an outer diameter of 12 mm fixed to or integral with the aforementioned rotary shaft Jb3 and which comprises contact rollers SRc on the right and left sides in contact with the aforementioned fixing roller 17*a*, (9) a rotary shaft Jb4 having an outer diameter of 8 mm, and (10) a fourth temperature-equalizing roller unit TUb4 which is composed of the aluminum material with an outer diameter of 12 mm fixed to or integral with the aforementioned rotary shaft Jb4 and which comprises contact rollers SRd in contact with the aforementioned fixing roller 17*a* over the entire area. In conformity to the size and number of the transfer materials to be used, a multiple number of temperature-equalizing roller units are provided on the temperature-equalizing roller unit group TUb.

Temperature-equalizing roller portions are pressed against the first to fourth temperature-equalizing roller unit TUb1, TUb2, TUb3 and TUb4 at a specified load with respect to the central roller Rt, or the temperature-equalizing roller portion is supported at a shaft center distance.

The temperature-equalizing roller unit group TUb has multiple modes of contact under pressure in conformity to the first to fourth temperature-equalizing roller units TUb1, TUb2, TUb3 and TUb4.

In other words, according to the present embodiment, only one of the contact rollers SRa, SRb and SRc on the right and left sides of the first to three temperature-equalizing roller units TUb1, TUb2 and TUb3 is formed to contact the fixing roller 17*a* under pressure in conformity to the transfer material width, as shown in FIG. 20. The portion corresponding to the transfer material width is formed of rotary shafts Jb1, Jb2 and Jb3 having an outer diameter of 8 mm, without contacting the fixing roller 17*a*. This makes it possible to cope with three types of small-sized transfer materials. One out of four rollers—the contact roller SRd of the fourth temperature-equalizing roller unit TUb4—contacts the fixing roller 17*a* under pressure over the entire width of transfer material feed width according to the present embodiment (hereinafter referred to as "full-width contact roller SRd"). The mode of contact under pressure is selected according to the temperature of contact rollers Sra, SRb and SRc provided on the first to fourth temperature-equalizing roller units TUb1, TUb2, TUb3 and TUb4, the width of the transfer material, or a combination of temperature of the contact rollers SRa, SRb, SRc and SRd, and transfer material width.

As shown in FIG. 19(A), the temperature-equalizing roller unit TUb is held at a position separate from the fixing roller 17*a* at the time of preheating of the fixing unit 17. If the width of the transfer material to be fixed is almost the same as that of the heating area even after fixing operation has started, the unit is still located at a separate position, without taking part in the fixing operation.

When the transfer material to be fixed is small for the heating area of the fixing roller 17*a* as shown in FIG. 19(B), the temperature-equalizing roller unit having temperature-equalizing roller corresponding to the transfer width is pressed against the fixing roller 17*a* at a specified pressure synchronously with the start of fixing operation by means of the arrangement of pressing the roller and releasing it (not illustrated). (In the present embodiment shown in FIG. 19(B), pressure is applied to the contact roller SRa on the right and left sides of the first temperature-equalizing roll unit TUb1 corresponding to the small-sized transfer material feed width shown in FIG. 20). In the case of the minimum transfer material feed width, e.g. A4-sized longitudinal width (210 mm), pressure is applied to the contact roller SRb on the right and left sides of the second temperature-equalizing roller unit TUb2. The temperature-equalizing rollers on the right and left sides to be pressed in contact (the contact roller SRa on the right and left sides of the first temperature-equalizing roller unit TUb1 in FIG. 19(B)) 20 removes the extra heat of the non-paper feed area from the fixing roller 17*a*, and transmits (disperse) it to the center roller Rt. Further, heat is transmitted (dispersed) from the center roller Rt to other temperature-equalizing rollers (in the present embodiment shown in FIG. 19(B), the contact rollers SRb and SRc on the right and left sides of the second and third temperature-equalizing roller units TUb2 and TUb3 shown in FIG. 20 and the full-width contact roller SRd of the fourth temperature-equalizing roller unit TUb4). The rubber layer as a elastic body provided on the center roller Rt ensures a reliable contact between the contact rollers SRa, SRb and SRc on the right and left sides as temperature-equalizing rollers and full-width contact roller SRd and center roller Rt.

When the number of prints is small, the temperature-equalizing roller unit group TUb is fed back to the detached position shown in FIG. 19(A) from the fixing roller 17*a*, upon completion of fixing operation. Heat stored in each temperature-equalizing roller is left to natural heat dissipation.

When printing is performed using many small-sized transfer materials in the process of continuous or intermittent fixing, the effect of removing extra heat at the end of the fixing roller 17*a* is reduced by the temperature rise of the temperature-equalizing roller to be brought in contact (in the present embodiment shown in FIG. 19(B), contact rollers SRa on the right and left sides of the first temperature-equalizing roller unit TUb1) In this case, when the temperature of the temperature-equalizing roller to be brought in contact (contact rollers SRa on the right and left sides of the first temperature-equalizing roller unit TUb1 in the present embodiment shown in FIG. 19(B)) has reached a specified level or a specified number of prints have passed by, the temperature-equalizing roller of the temperature-equalizing roller unit corresponding to the transfer material width (contact roller SRa of the first temperature-equalizing roller unit TUb1 in the present embodiment shown in FIG. 19(B)) is separated from the fixing roller 17*a*, and the full-width contact roller SRd of the fourth temperature-equalizing roller unit TUb4 is brought in contact with the fixing roller 17*a* at a specified pressure. The full-width contact roller SRd serves as a path for transferring (dissipating) heat from the non-paper feed area conforming to the temperature difference of the fixing roller 17*a* to the paper feed area (large-sized transfer material feed width of the fourth temperature-equalizing roller unit TUb4 in the present embodiment shown in FIG. 20), thereby ensuring uniform temperature of the fixing roller 17*a*.

When the small-sized transfer material is passed, the full-width contact roller SRd is brought in contact with the fixing roller from the beginning, if the temperature of a corresponding temperature-equalizing roller (any one of contact rollers SRa, SRb and SRc on the right and left sides of the first to third temperature-equalizing roller units TUb1, TUb2 and TUb3 in the present embodiment) shown in the drawing) is already higher than the specified value at the start of fixing operation.

In order to protect the fixing roller 17*a* against mechanical damage, the end of the area in contact with the fixing roller 17*a* of the temperature-equalizing roller is designed to have a gradually decreasing radius, as shown in FIG. 20. This arrangement prevents an abrupt temperature difference from occurring to the fixing roller 17*a* on the boundary between the contact area and non-contact area of each temperature-equalizing roller with the fixing roller 17*a* with resultant thermal-related damage. It also prevents difference in gloss from occurring on this boundary when fixing of the large-sized transfer materials continues.

As shown in FIG. 21, the fixing unit 17*a* is formed of the fixing roller 17*a* and pressure roller 47*a*. To ensure uniform temperature on the surface of the fixing roller 17*a*, a temperature-equalizing roller unit group TUc having the temperature-equalizing roller which allows selection between contact or non-contact to the fixing roller 17*a* is provided as a temperature-equalizing roller unit member, instead of the temperature-equalizing roller unit TUb described with reference to the drawings of FIG. 19(A) and FIG. 19(B).

The temperature-equalizing roller unit group TUc is the temperature-equalizing roller unit group TUb described with reference to FIG. 19(A) and FIG. 19(B) from which the center roller Rt is removed. It is used as a temperature-equalizing roller unit, and comprises first to fourth temperature-equalizing roller units TUb1, TUb2, TUb3 and TUb4 which are in contact with each other at adjacent places. In this case, the number of the contact rollers SRa, SRb, SRc and SRd as temperature-equalizing rollers provided on the first to fourth temperature-equalizing roller units TUb1, TUb2, TUb3 and TUb4 equipped with rotary shafts Jb1, Jb2, Jb3 and Jb4 is restricted to even numbers in order to adjust the rotary direction. To ensure mutual contact among contact rollers SRa, SRb, SRc and SRd, a rubber layer as an elastic layer is formed on the surfaces of half of them, and those with rubber layer and those without it are placed at alternate positions. The shape, layout and operation of each of the temperature-equalizing roller units and temperature-equalizing rollers are the same as those described in with reference to FIGS. 8 and 9.

In the above embodiments with reference to FIGS. 19(A) to 21, the temperature-equalizing roller unit can be the one composed of the temperature-equalizing roller integrated with rotary shaft.

As described above, it is possible to provide an image forming apparatus equipped with a fixing unit capable of quick start and best suited to color image forming, wherein heat dissipation is carried out in the appropriate area of the fixing roller member by the temperature-equalizing roller unit, and temperature rise on the fixing roller member end is held down in the continuous feed process especially for small-width transfer materials, despite a simple configuration, without affecting the preheating time of the fixing unit.

In the description of the embodiment with reference to FIGS. 19(A) to 21, the transfer material passes approximately at the center of the fixing roller provided on the fixing unit. When the transfer material is fed with one side of the fixing roller member used as a reference, the same application is possible if the large-diameter portion of the temperature-equalizing roller formed on each temperature-equalizing roller unit is used as one side. The configuration of the fixing roller member and temperature-equalizing roller unit is not restricted to the above. The material and size is preferred to be selected as appropriate in conformity to the fixing capacity of the fixing unit to be applied and tolerance of fixing temperature.

In the embodiment described with reference to FIGS. 19(A) to 21, a glass member is used as a substrate for the fixing roller member of the fixing unit, as described above with reference to FIG. 14. The same effect can be obtained from the use of a fixing roller member with an elastic layer formed on the metallic metallic core. Further, the same effect can also be gained in the fixing unit where the thin-walled metallic pipe is used as a fixing roller member.

The third embodiment of the present invention ensures uniform nip width in the nip portions (equalization roller nip portions) of the fixing roller member and temperature-equalizing roller, and effective heat dissipation from the fixing roller member by the temperature-equalizing roller. Despite a simple configuration, the present invention holds down temperature rise on the fixing roller member end in the continuous feed process especially for small-width transfer materials, without affecting the preheating time of the fixing unit, and provide an image forming apparatus equipped with a fixing unit capable of quick start and best suited to color image forming.

The third embodiment of the present invention avoids mutual phase deviation among temperature-equalizing rollers, and allows the temperature-equalizing rollers to be placed symmetrical to each other with respect to the center position of the transfer material feed width, whereby contact is made at a fixed position of the temperature-equalizing roller.

The third embodiment of the present invention provides an image forming apparatus equipped with a fixing unit capable of quick start and best suited to color image forming, wherein heat dissipation is carried out in the appropriate area of the fixing roller member by the temperature-equalizing roller unit, and temperature rise on the fixing roller member end is held down in the continuous feed process for especially small-width transfer materials, despite a simple configuration, without affecting the preheating time of the fixing unit.

[Fourth Embodiment]

Figure 22:
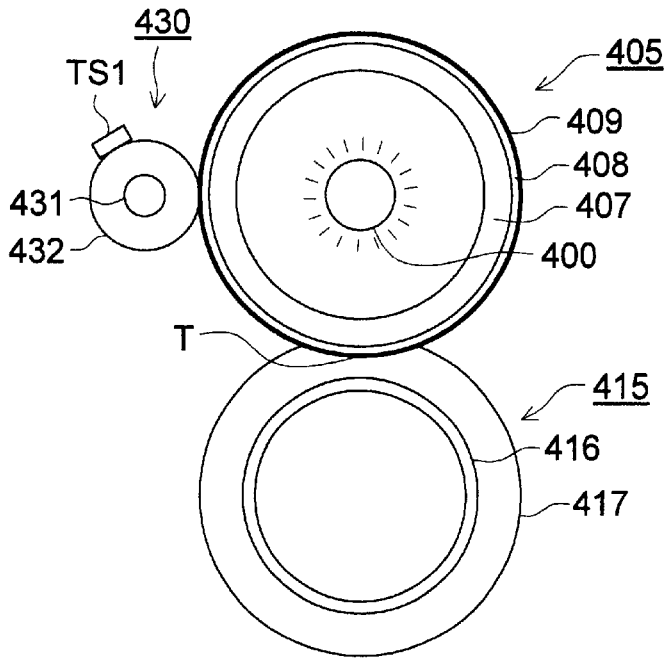
FIG. 22 is a schematic side view representing the configuration of the fixing roller, nip roller and temperature-equalizing roller as major constituents of the fixing unit.

As shown in FIG. 22, the fixing unit 30 according to the fourth embodiment incorporates a halogen heater (halogen lamp) 400, and comprises a fixing roller 405 which can rotate round the halogen lamp and a nip roller 415 which can rotate in contact with the aforementioned fixing roller 405. Symbol T denotes a nip portion.

The roller core of the above-mentioned fixing roller 405 is composed of a transparent base body, and is made of a glass having an outer diameter of 27 mm and a thickness of 1.6 mm in the present embodiment.

A transparent silicone rubber is formed on the outside (outer periphery) of the aforementioned roller core. Its further outside surface is covered with the heat resistant tube composed of the PFA (perfluoro alkoxy) which is mixed with carbon black or the like to improve light absorption.

The aforementioned nip roller 415 has a silicone rubber surface formed on the roller core.

FIG. 22 is a schematic side view representing the configuration of the fixing roller 405, nip roller 415 and temperature-equalizing roller 430 as the major components of the fixing unit 30.

In the drawing, the fixing roller 405 is located on the side in contact with the unfixed toner image on paper P (not illustrated). The fixing roller 405 and nip roller 415 are brought in contact with each other at a specified pressure, and rotate in the same direction on the contact portion (nip portion T) while the state of contact is maintained during the operation, whereby the aforementioned unfixed toner image is fixed by heat and pressure.

As described above, the aforementioned fixing roller 405 comprises a roller core 407 composed of a cylindrical transparent base body (glass, etc.), a translucent elastic layer (transparent silicone rubber layer) 408 formed on the outside (outer surface) of the roller core 407, and a heat absorbing layer (also serving as a mold release layer for toner) 409 formed on the further outside.

The aforementioned nip roller 415 is formed as a cylindrical metallic pipe 416 composed, for example, of an aluminum material, and a soft roller made of the outer surface of the metallic pipe 406 covered, for example, with silicone rubber layer 407.

The major components of the temperature-equalizing roller 430 according to the present invention are a roller part 432 and shaft 431. A temperature sensor TS is arranged on the outer surface of the roller part 432, and the roller is pressed against the fixing roller 405 on the outer surface of the heat absorbing layer 409. The aforementioned temperature sensor TS detects the surface temperature of the roller part 432, and the detected information is sent to the controller of the image forming apparatus, because it is important to select between pressing of the temperature-equalizing roller 430 against the fixing roller 405 and release of such pressing, or to select the angle.

In addition to glass which is defined as an inorganic substance made of the molten substance having been cooled and solidified without segregation of the crystal, pyrex glass for transmitting light from such a irradiation member as halogen heater 400 (halogen lamp), sapphire ($Al_2O_3$), ceramic material such as $CaF_2$, and translucent resin such as polyimide and polyamide can be used as the transparent base body (roller core) 407 constituting the aforementioned fixing roller 405. To ensure an effective heat absorption of heat of the halogen lamp and xenon lamp installed on the inner side of the aforementioned roller core, a tube composed of the PFA (perfluoro alkoxy) mixed with the powder of carbon black, graphite, ($Fe_3O_2$) and various types of ferrite can be installed on the outer side of the aforementioned transparent silicone rubber layer to form the aforementioned heat absorbing layer.

The fixing roller can also be designed in the following configuration: A heat conductive rubber layer comprising silicone rubber forming by mixing of powder of metallic oxides such as silica, alumina and magnesium oxide as a feeler can be formed on the outside of the roller core mentioned above. Also, an integral heat absorbing layer can be formed by integration of two layers; (1) a heat absorbing layer forming by mixing of powder of carbon black, graphite, black iron oxide, various types of ferrite, their compound, copper oxide, cobalt oxide, red oxide or the like, and (2) a mold release layer forming by mixing of the fluorine resin paint serving both as binder and mold release agent. As described above, this fixing roller provides a extensive designing flexibility.

Figure 23:
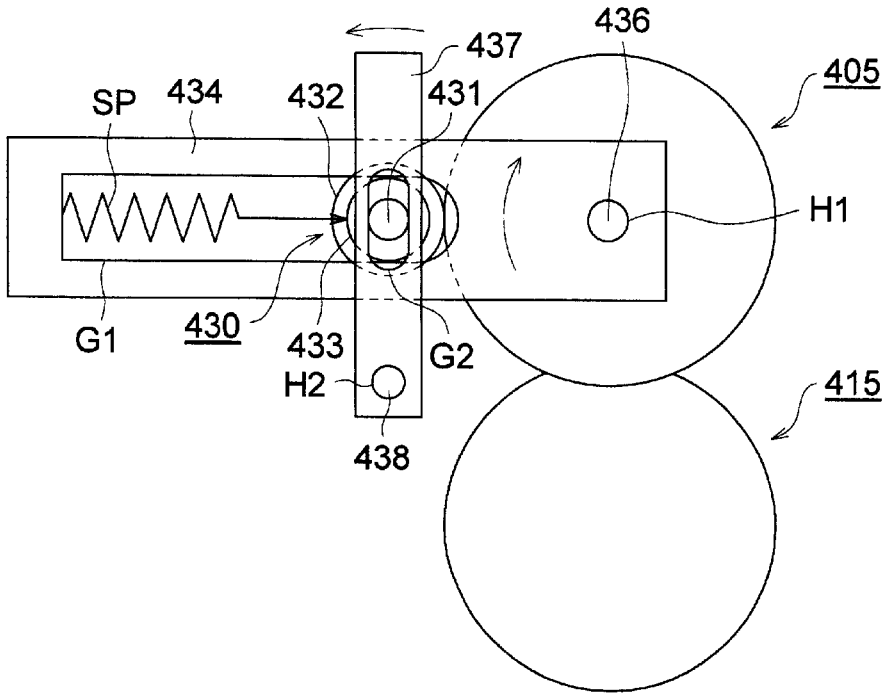
FIG. 23 is a schematic view representing the arrangement of the mechanism of pressing the temperature-equalizing roller and releasing it according to the present invention.

FIG. 23 is a schematic view representing the arrangement of the mechanism of pressing one of the temperature-equalizing rollers and releasing it according to the present invention. FIG. 24 is a schematic view representing the case where the shafts of the fixing roller and temperature-equalizing roller agree with each other and are tilted with each other by a certain angle. FIG. 25(*a*) and FIG. 25(*b*) is a schematic view representing the state of clearance when the fixing roller and temperature-equalizing roller are pressed against each other.

In FIGS. 23 and 24, numeral 405 denotes a fixing roller, 415 a nip roller and 430 a temperature-equalizing roller.

A shaft 431 and roller part 432 are major components of temperature-equalizing roller 430. The ends on the right and left sides of the aforementioned roller part 432 are designed in a gradual curve so that the fixing roller 405 is not subjected to any mechanical damage.

In the configuration of the present embodiment, the temperature-equalizing roller 430 is formed by fluorine coating on the surface of the solid roller (round rod) composed of an aluminum material having an outer diameter of 10 mm. The temperature-equalizing roller 430 in the present embodiment requires excellent heat conductivity, as will be described later. So it is preferred to use the material such as aluminum or copper which has a high heat conductivity. Use of a heat pipe is also preferred.

The temperature-equalizing roller 430 is pressed against the surface of the fixing roller 405 at a certain pressure and rotates following the movement of the fixing roller 405. At the same time, pressing can be released. Further, the angle formed by the axes of the temperature-equalizing roller 430 and fixing roller 405 can be changed. This arrangement makes it possible to change the range of clearance formed at the contact portion when the temperature-equalizing roller 430 is pressed against the fixing roller 405. Irregularities in temperature distribution on the fixing roller 405 can be reduced by a combination of the aforementioned change of the range and the arrangement of pressing the temperature-equalizing roller 430.

Numeral 434 denotes a movable side plate which can be freely rocked using a fulcrum 436 fixed onto the frame of fixing unit proper (not illustrated) as a rotary shaft. In the hole H1 formed on one end of the aforementioned movable side plate 434, there is a groove G1 which is engaged with the aforementioned fulcrum 436 and extends to the other end in the longitudinal direction. Shaft 431 of the temperature-equalizing roller 430 is held by bearing 433, and the bearing 433 is movably installed to the groove G1 of the movable side plate 434. The bearing 433 is energized toward the fixing roller 405 by a spring SP. The shaft 431 is energized through the bearing 433 with the result that the temperature-equalizing roller 430 is pressed against the fixing roller 405.

Numeral 437 denotes a press release lever for releasing the aforementioned temperature-equalizing roller 430 pressed against the fixing roller 405. At the end in the longitudinal direction, the press release lever 437 has a hole H2 which is rotatably fitted to the fulcrum 438 the frame of the fixing unit proper (not illustrated). Approximately at the center there is a groove G2 extending in the longitudinal direction. One of the shafts 431 of the aforementioned temperature-equalizing rollers 430 is movably fitted into the groove G2. The press release lever 437 is subjected to the load against the load of the aforementioned spring SP by the known means such as a motor, solenoid valve or cam mechanism (not illustrated). It is energized in the direction marked with an arrow using the fulcrum 438 as a rotary shaft, and detaches the temperature-equalizing roller 430 from the fixing roller 405 through the shaft 431, whereby pressing is released.

As will be apparent from the drawing, the mechanism of pressing the temperature-equalizing roller 430 and releasing it is arranged symmetrically to the right and left with the fixing roller 405 sandwiched in-between. The same symbols are assigned to the same structures on the right and left.

In this embodiment, the movable side plate 434 rotates about the fulcrum 436, and only one of the shafts 431 of the temperature-equalizing roller 430 is lifted in the arrow marked direction. The fixed side plate 435 is secured onto the frame of the fixing unit proper (not illustrated). In other words, the fixed side plate 435 is the same as the movable side plate 434 in the outer shape and groove shape. While the movable side plate 434 is movable about the fulcrum 436, the fixed side plate 435 is movable about the fulcrum 436 is secured to the frame of the fixing unit proper by means of screws (not illustrated). Similarly to the aforementioned shaft 431, the other shaft (shaft on the fixed side) 431 of the temperature-equalizing roller 430 is supported by the bearing movably arranged in the groove of the fixed side plate 435 (bearing on the fixed side) 433. The aforementioned specified pressure at which temperature-equalizing roller 430 is pressed against the fixing roller 405 is obtained when one end of each of the springs SP on the right and left sides presses the bearing 433 and the temperature-equalizing roller 430 is pressed against the fixing roller 405 through the shaft 431.

When the movable side plate 434 is made to rotate around the aforementioned fulcrum 436 in the arrow marked direction (FIG. 23) e.g. by the motor as a drive source (not illustrated) whose rotation can be reversed, the shafts of the temperature-equalizing roller 430 and fixing roller 405 can be tilted a certain angle (the position indicated by a two-dot chain line in FIG. 24). Further, the rotation of the aforementioned motor can be reversed to get back to the position parallel to the fixing roller 405 (hereinafter referred to as "reference position") before the temperature-equalizing roller 430 is tilted.

In the drive control of the aforementioned motor, it is sufficient that the motor in the forward or reverse direction is driven, using the reference position of the aforementioned temperature-equalizing roller 430 as an origin. The current carrying time of the motor can be controlled as appropriate by a drive controller. It goes without saying that the drive controller has a means for memorizing the position of the temperature-equalizing roller 430 and a computing means for setting the motor rotation either in the forward or reverse direction in conformity to the conditions to be described later.

With reference to FIG. 25(*a*) and FIG. 25(*b*), the following describes the characteristics of a clearance formed by the temperature-equalizing roller 430 and fixing roller 405 when the temperature-equalizing roller 430 is pressed against the fixing roller 405:

FIG. 25(*a*) is a schematic view representing the clearance formed with the fixing roller 405 when the temperature-equalizing roller 430 is located at the aforementioned reference position. FIG. 25(*b*) is a schematic view representing the clearance formed between the shaft 431 of the temperature-equalizing roller 430 and the fixing roller 405 when former is maximally tilted with respect to the latter.

In the drawing, the range indicated by letter of reference R denotes a heat area where fixing can be performed by the fixing roller 405 (the maximum paper width in the direction at a right angle to the direction where usable paper is transported). The range denoted by the letter of reference S indicates the heat area required for the small-sized usable paper.

In FIG. 25(*a*), the shaft 431 on both ends of the temperature-equalizing roller 430 receives a specified load F1 from the springs SP (FIG. 23) 434 and 435 (FIG. 24) arranged on the side plate 432 through the bearing 433 (FIG. 24). The temperature-equalizing roller 430 having the load applied to its shaft 431 on both ends is pressed against the fixing roller 405, but receives reaction F2 from the fixing roller 405 at the same time. As illustrated, the temperature-equalizing roller 430 is bent under the bending force applied from the aforementioned reaction F2 and the aforementioned load F1. The fixing roller is pressed at a high pressure on both ends, but is detached from the fixing roller 405 at the center to form a clearance. Accordingly, the contact area at the nip portion between the temperature-equalizing roller 430 and fixing roller 405 is larger at a position farther from the end, and is smaller closer to the center.

In the aforementioned reference position, the range T of the clearance formed at the center (the length of the fixing roller in the axial direction) varies according to the length and rigidity of the temperature-equalizing roller 430, the elasticity of the rubber layer 408 of the fixing roller 405 and load of the aforementioned spring SP. These values can be selected and determined as appropriate.

The value representing the range T where the aforementioned clearance is formed is set to almost the same size as that of the heat area S required for small-sized usable paper, for example, by changing the load F1 of the aforementioned spring SP. Then the range of the contact portion of the aforementioned temperature-equalizing roller 430 agrees with the area on both ends of the fixing roller 405 heated excessively in the process of continuous fixing of the aforementioned less wide paper. High heat on the aforementioned both ends shifts to the temperature-equalizing roller 430. As explained above, the contact area between the temperature-equalizing roller 430 and fixing roller 405 is greater at a position closer to the end, and becomes gradually smaller closer to the center. This will result in a gradual variations in temperature distribution of the fixing roller 405. Even if large-sized paper is fixed after small-sized paper, gloss irregularities are reduced to an almost invisible extent.

In FIG. 23, when the movable side plate 434 is driven by the aforementioned reversible motor (not illustrated) through the groove G1 of the movable side plate 434, bearing 433 and shaft 431, it is possible to change the angle formed by the shafts of the temperature-equalizing roller 430 and fixing roller 405 (to tilt a specified angle from the reference position). This makes it possible to change the value for the range T where the aforementioned clearance is formed at the reference position. In other words, when the temperature-equalizing roller 430 is located at the aforementioned reference position, the clearance forming range takes the maximum value. As the movable side plate 434 is driven, the aforementioned clearance forming range T is reduced accordingly. In FIG. 25(*b*), when the movable side plate 434 is maximally rotated, the aforementioned clearance forming range is reduced to almost zero. It shows that the contact surface of the temperature-equalizing roller 430 is pressed against the outer surface of the fixing roller 405 over the entire area in the longitudinal direction.

Whether the temperature-equalizing roller 430 is pressed against the to the fixing roller 405 or not depends on the control made by the controller of the image forming apparatus based on the information on the width of the next paper to be fixed and the surface temperature of the temperature-equalizing roller 430 at that time. In other words, the temperature-equalizing roller 430 is not pressed against the fixing roller 405 when the next paper has the maximum width, but is pressed against it when the paper with smaller width follows. When pressing is not performed (when preheating is performed or the next paper to be fixed has the maximum width), a press release command is issued to the motor (not illustrated) for driving the aforementioned press release lever 437.

In response to this command, the aforementioned motor rotates the press release lever 437. Then the temperature-equalizing roller 430 is detached from the fixing roller 405. When pressing is performed (with smaller paper width), no command is issued from the aforementioned controller, so the release lever 437 is not operated. The temperature-equalizing roller 430 is energized by the aforementioned spring SP and is brought in contact with the fixing roller 405.

If the number of sheets of small-width paper to be fixed is small, e.g. 5 or less, it is possible to release the pressing of the temperature-equalizing roller 430, thereby reducing flow of heat to the temperature-equalizing roller 430.

In the event of rise of surface temperature of the temperature-equalizing roller 430 due to a great amount of small-width paper, there is concern for an abnormal rise of surface temperature on both ends of the fixing roller 405 (area from the inner side of the maximum paper width R to the outer side of the smaller paper width S). So the relative angle is changed to ensure that temperature-equalizing roller 430 and fixing roller 405 are brought in contact with each other over almost the entire area. In other words, when the temperature detected by the temperature sensor TS installed on the outer surface of the temperature-equalizing roller 430 has exceeded a specified level, information on the temperature from the aforementioned temperature sensor TS and information on the size of paper to be used are entered by the controller of the image forming apparatus and are processed by computation. Then the movable side plate 434 is rotated by through the aforementioned reversible motor in response to the command from the aforementioned controller, and the angle formed between the shafts of the temperature-equalizing roller 430 and fixing roller 405 is maximally shifted. Shifting of the aforementioned angle eliminates clearance in the contact portion the temperature-equalizing roller 430 at the center and the fixing roller 405, resulting in a close contact over almost the entire area in the longitudinal direction. Heat stored on both ends of the fixing roller 405 of lower heat conductivity is transmitted to the center of the fixing roller 405 through the temperature-equalizing roller 430 of high heat conductivity, with the result that a uniform temperature distribution of the fixing roller 405 is provided.

When there is a small number of the sheets of less wide paper to be fixed, the temperature-equalizing roller 430 is placed in a standby position at the press release position upon completion of fixing, so that accumulated heat can be subjected to heat dissipation.

For simplicity, the aforementioned explanation has taken examples of two types of paper—paper with the maximum width to be used and small-width paper—in the heat area where fixing can be performed by the fixing roller 405. However, control can be made to conform to the paper of intermediate width by setting the tilt angle of the temperature-equalizing roller 430 at a desired intermediate position from the reference position to the maximum angle.

The press release mechanism of temperature-equalizing roller 430 has been described in the case of shifting only one shaft. Needless to say, it is also possible to shift both shafts in the direction opposite to each other at the same time.

The above has explained the configuration where the roller core of the fixing roller is made of a transparent base body such as glass. The same effect can be obtained when a thin-walled metallic pipe is used. In this case, however, it is necessary to make sure of the contact area when the temperature-equalizing roller is in contact with the fixing roller. It is preferred that such an elastic layer silicone rubber be provided on the surface.

The configuration of the fixing roller 405 and temperature-equalizing roller 430 is not restricted to any particular embodiments. An appropriate size and material can be selected in conformity to the fixing capacity of the fixing unit and the specifications on fixing temperature. In the present embodiment, a solid roller is used as temperature-equalizing roller 430. It goes without saying that a pipe material can be used.

No mention has been made of temperature control in the above description. In the control of the fixing roller temperature, it is possible to use the known method where a temperature detecting element is installed in the vicinity of the surface of fixing roller corresponding to the small-width paper feed area, and the electric power supply to the heat source is turned on or off according to the information output from the aforementioned temperature detecting element.

According to the fourth embodiment of the present invention, a very simple configuration allows the temperature difference between the paper feed area and non-paper feed area on the fixing roller to be controlled in the process of continuous fixing of a great amount of small-width paper. Thus, this arrangement provides a stable fixing practically without difference in the gloss of toner image in the boundary between the aforementioned two areas, even if large-width paper is used immediately after the aforementioned small-sized paper.

Disclosed embodiment can be varied by a skilled person without departing form the spirit and scope of the invention.

What is claimed is:

1. A fixing unit, comprising:

a fixing belt threaded on a plurality of supporting rollers; and a temperature-equalizing member to equalize a temperature distribution of said fixing belt in its width direction;

wherein said temperature-equalizing member moves from a separate position to a first pressure-contacting position at which said temperature-equalizing member pressure-contacts said fixing belt, and further moves to a second pressure-contacting position while maintaining a pressure-contacting state with said fixing belt; and wherein a contact area of said temperature-equalizing member and said fixing belt is enlarged at said second pressure-contacting position, compared to that at said first pressure-contacting position, and said temperature-equalizing member can park at either said first pressure-contacting position or said second pressure-contacting position.

2. The fixing unit of claim 1, wherein said temperature-equalizing member is pressed onto a supporting roller, serving as one of said supporting rollers, with said fixing belt between them, and moves along an outer shape of said supporting roller.

3. The fixing unit of claim 1, wherein said temperature-equalizing member is a metallic roller.

4. The fixing unit of claim 3, wherein said metallic roller comprises:

a release layer having a thickness in a range of 10–100 $\mu$m and provided on an outer surface of said metallic roller.

5. The fixing unit of claim 1, wherein said temperature-equalizing member moves from said first pressure-contacting position to said second pressure-contacting position either continuously or step by step.

6. An image-forming apparatus having a function of fixing a toner image onto a sheet, comprising:

a fixing belt threaded on at least two of supporting rollers; and a temperature-equalizing member equipped in a vicinity of a supporting roller, serving as one of said supporting rollers, to equalize a temperature distribution of said fixing belt in its width direction;

a sheet-size detecting section to detect a size of said sheet currently selected;

a temperature detecting section to detect a temperature of said temperature-equalizing member; and a controlling section to control a moving action of said temperature-equalizing member so that, when said sheet-size detecting section detects that said size of said sheet is small, said temperature-equalizing member pressure-contacts said fixing belt at a first contacting position, and to change a contact angle of said fixing belt, when said temperature detecting section detects that said temperature of said temperature-equalizing member exceeds a reference value.

7. The image-forming apparatus of claim 6, wherein, when said temperature of said temperature-equalizing member, positioned at said first contacting position, exceeds said reference value, said controlling section controls said moving action of said temperature-equalizing member so that said temperature-equalizing member moves along an outer shape of said supporting roller to a second contacting position, while being pressed onto said supporting roller with said fixing belt between them.

8. An image forming apparatus having a function of fixing a toner image onto a sheet, comprising:

a fixing roller, including a heater and a base body on which an elastic layer is formed; and a temperature-equalizing roller to equalize a temperature distribution of said fixing roller in its width direction;

wherein said temperature-equalizing member can pressure-contact said fixing roller with a pressure-contacting force, and can be released from a pressure-contacting state; and wherein a value of said pressure-contacting force is selectable in a plurality of step values.

9. An image-forming apparatus having a function of fixing a toner image onto a sheet, comprising:

a fixing roller, including a heater and a base body on which an elastic layer is formed; and a temperature-equaling roller unit, including a temperature-equalizing roller, and a shaft serving as a rotating axis of said temperature-equalizing roller;

wherein said temperature-equalizing roller pressure-contacts said fixing roller at a pressure-contacting area, being equivalent to a partial length of said fixing roller, so as to equalize a temperature distribution of said fixing roller in its width direction; and wherein said temperature-equalizing roller is movably coupled to said shaft, so that said temperature-equalizing roller can move in a longitudinal direction of said shaft in order to change a length and/or a position of said pressure contacting area.

10. The image-forming apparatus of claim 9, wherein said temperature-equalizing roller is movably coupled to said shaft by engaging female and male screws formed on said temperature-equalizing roller and said shaft respectively.

11. The image-forming apparatus of claim 9, wherein a rotating velocity of said shaft is variable.

12. The image-forming apparatus of claim 10, wherein two temperature-equalizing rollers are movably coupled to said shaft, and a winding direction of said female screw formed on one of said two temperature-equalizing rollers is opposite to that formed on the other one.

13. The image-forming apparatus of claim 12, wherein a total length of said two temperature-equalizing rollers is substantially equal to a maximum width of said sheet.

14. An image-forming apparatus having a function of fixing a toner image onto a sheet, comprising:

a fixing roller, including a heater and a base body on which an elastic layer is formed; and a temperature-equalizing roller unit to equalize a temperature distribution of said fixing roller in its width direction;

wherein said temperature-equalizing roller unit includes two temperature-equalizing rollers, a shaft serving as a rotating axis of said two temperature-equalizing rollers and a phase deviation preventive member to fix a mutual phase relationship between said two temperature-equalizing rollers in respect to said shaft; and wherein said two temperature-equalizing rollers are movable in a longitudinal direction of said shaft.

15. The image-forming apparatus of claim 14, wherein said phase deviation preventive member is insertably and drawably engaged into said two temperature-equalizing rollers.

16. The image-forming apparatus of claim 14, wherein a total length of said two temperature-equalizing rollers is substantially equal to a maximum width of said sheet.

17. The image-forming apparatus of claim 8, wherein said fixing roller comprises a transparent base body.

18. The image-forming apparatus of claim 8, wherein a diameter of said temperature-equalizing roller gradually decreases according as a position of said diameter approaches an end of said temperature-equalizing roller, so that said temperature-equalizing roller partially contacts said fixing roller.

19. An image-forming apparatus having a function of fixing a toner image onto a sheet, comprising:

a fixing roller, including a heater and a base body on which an elastic layer is formed; and a plurality of temperature-equalizing roller units, each of which includes a temperature-equalizing roller fitted on a shaft serving as a rotating axis of said temperature-equalizing roller, said temperature-equalizing roller pressure-contacting said fixing roller at a pressure-contacting area, being equivalent to a partial length of said fixing roller, so as to equalize a temperature distribution of said fixing roller in its width direction;

wherein each of said temperature-equalizing roller units, pressure-contacts said fixing roller at a pressure contacting area, wherein said pressure-contacting areas are different relative to each other in length and/or position, corresponding to a plurality of pressure-contacting modes.

20. The image-forming apparatus of claim 19, wherein one of said pressure-contacting modes is selected corresponding to temperatures of temperature-equalizing rollers mounted on said temperature-equalizing roller units, or a width of said sheet, or combination of said temperatures of said temperature-equalizing rollers and said width of said sheet.

21. The image-forming apparatus of claim 19, wherein said temperature-equalizing roller units contact a non-contacting roller, which is not in contact with said fixing roller.

22. The image-forming apparatus of claim 21, wherein a surface of said non-contacting roller is coated with an elastic material.

23. The image-forming apparatus of claim 19, wherein said temperature-equalizing roller units are disposed at adjacent positions, so that said temperature-equalizing roller units contact each other.

24. The image-forming apparatus of claim 23, wherein a number of said temperature-equalizing roller units is an even number.

25. The image-forming apparatus of claim 24, wherein surfaces of temperature-equalizing rollers, mounted on at least a half number of said temperature-equalizing roller units, are coated with an elastic martial.

26. The image-forming apparatus of claim 19, wherein said fixing roller comprises a transparent base body.

27. The image-forming apparatus of claim 19, wherein one of said temperature-equalizing roller units comprises a temperature-equalizing roller, and a diameter of said temperature-equalizing roller gradually decreases according as a position of said diameter approaches an end of said temperature-equalizing roller, so that said temperature-equalizing roller partially contacts said fixing roller.

28. A fixing unit, comprising:

a fixing roller; and a temperature-equalizing roller to equalize a temperature distribution of said fixing roller in its width direction;

wherein said temperature-equalizing member can pressure-contact said fixing roller, and can be released from a pressure-contacting state; and wherein an angle, at which a rotating axis of said temperature-equalizing roller is inclined to that of said fixing roller, is changeable.

29. The fixing unit of claim 28, wherein said angle can be controlled in response to a width of a sheet being under a fixing operation.

30. The fixing unit of claim 28, wherein said angle can be controlled in response to a temperature of said temperature-equalizing roller.

31. The fixing unit of claim 28, wherein said fixing roller comprises a transparent base body and a transparent elastic layer.

* * * * *